US012631387B2

(12) United States Patent
Wang

(10) Patent No.: US 12,631,387 B2
(45) Date of Patent: May 19, 2026

(54) GREEN ENERGY-SAVING COLD STORE

(71) Applicant: Enrong Wang, Lanzhou (CN)

(72) Inventor: Enrong Wang, Lanzhou (CN)

(73) Assignee: Enrong Wang, Lanzhou (CN)

( * ) Notice: Subject to any disclaimer, the term of this patent is extended or adjusted under 35 U.S.C. 154(b) by 0 days.

(21) Appl. No.: 19/324,066

(22) Filed: Sep. 9, 2025

(65) Prior Publication Data

US 2026/0009577 A1 Jan. 8, 2026

Related U.S. Application Data

(63) Continuation of application No. PCT/CN2024/096201, filed on May 30, 2024.

(30) Foreign Application Priority Data

Jun. 9, 2023 (CN) ..... 202310684511.9

(51) Int. Cl.
*F25D 13/06* (2006.01)
*F25D 23/06* (2006.01)

(52) U.S. Cl.
CPC ..... *F25D 13/06* (2013.01); *F25D 23/065* (2013.01); *F25D 2201/126* (2013.01)

(58) Field of Classification Search
CPC ..... F25D 23/065; F25D 2201/12
See application file for complete search history.

(56) References Cited

U.S. PATENT DOCUMENTS

2013/0263614 A1* 10/2013 Tippmann ..... F25D 13/00 62/62
2020/0333060 A1 10/2020 Wu

FOREIGN PATENT DOCUMENTS

| | | | | |
|---|---|---|---|---|
| CN | 101520270 A | | 9/2009 | |
| CN | 204126326 U | * | 1/2015 | |
| CN | 215055820 U | | 12/2021 | |
| CN | 118029745 A | | 5/2024 | |
| EP | 3059528 A1 | * | 8/2016 | ..... F25D 17/005 |
| JP | H0518660 A | | 1/1993 | |
| JP | 2001311232 A | * | 11/2001 | |
| JP | 2008285851 A | * | 11/2008 | |

OTHER PUBLICATIONS

International Search Report of PCT/CN2024/096201(Aug. 20, 2024).

* cited by examiner

*Primary Examiner* — Lionel Nouketcha
(74) *Attorney, Agent, or Firm* — FIDELI LAW PLLC; Qiang Li

(57) ABSTRACT

A green energy-saving cold store is provided, including a cold room, a platform, a machine room, and a refrigerating system. A drying layer (1) is arranged below the first floor of the cold room; a ground heat insulation layer (2) is moved downwards into the drying layer (1) and is separated from a first floor slab (3); an inner wall (4), an internal partition wall, and the wear-resistant waterproof floor (33) are directly located on the first floor slab (3) and integrated with a frame structure; a peripheral protective wall adopts a light steel structure wall surface (14), and is connected to the frame structure by means of ball joint tie beams (15) at the intersection points between frame beams and columns. The cold store is energy-saving and environment-friendly, and has good anti-seismic and fireproof performance.

7 Claims, 40 Drawing Sheets

GREEN ENERGY-SAVING COLD STORE

RELATED APPLICATIONS

The present patent document is a continuation of PCT Application Serial No. PCT/CN2024/096201, filed May 30, 2024, designating the United States and published in English, which is hereby incorporated by reference.

The present patent document claims the benefit of priority to Patent Application No. 202310684511.9, filed Jun. 9, 2023, and entitled "GREEN ENERGY-SAVING COLD STORE," the entire contents of each of which are incorporated herein by reference.

BACKGROUND

1. Technical Field

The present disclosure relates to a green energy-saving cold store.

2. Background Information

The current design theory of a cold room is as follows. Under normal circumstances, water vapor in the atmosphere penetrates into the cold room through a peripheral protective wall, a leveling layer, a vapor barrier layer, a heat insulation layer and an inner wall, and frosts on an exhaust pipe or an air cooler. Frost has high porosity and low thermal conductivity, which is an obstacle to heat exchange of the exhaust pipe. Water condensation and freezing often occur in the heat insulation layer, especially in a roof the heat insulation layer and a ground heat insulation layer of the cold room in high-temperature and high-humidity areas. It is obvious that with high temperature and high humidity outside the cold room, low temperature and high humidity inside the cold room, and the moisture contained in building materials, water vapor in the heat insulation layer tends to enter easily but is difficult to escape. The roof the heat insulation layer and the ground heat insulation layer are closed in all directions, which sounds very safe. In fact, as long as there is partial pressure difference of water vapor, the penetration of water vapor is inevitable. Where is the escape route for the water vapor that penetrates into the heat insulation layer? Water accumulates more and more.

Some heat insulation layers may also produce harmful gases during construction.

In order to reduce cold bridges, the heat insulation layer of the peripheral protective wall and the column may separate the concrete ground and is integrally connected to the ground heat insulation layer. The inner wall and the internal partition wall are located on the concrete ground (an adhesive layer). During an earthquake, the concrete ground, together with the goods thereon, the inner wall, the internal partition wall, and the like, which are like ships floating on the heat insulation layer, do not vibrate synchronously with a main structure, thereby causing damage to the ground waterproof layer and the heat insulation layer, and leading to water ingress and failure of the heat insulation layer, as well as difficulties in maintenance.

Taking the fireproof performance into account, the peripheral protective wall generally uses brick walls of 240 mm, whose longitudinal stiffness is much greater than that of the main structure, especially for exterior walls without doors. However, the lateral stiffness of the brick wall is very small, and cannot stand independently. There are concrete anchor beams connected to the main structure. During an earthquake, the peripheral protective wall cannot vibrate in coordination with the main structure, often resulting in phenomena such as wall collapse and beam fracture. Recently, some people use reinforcements instead of concrete anchor beams. During an earthquake, reinforcements may produce plastic hinges to coordinate the differential vibration of the structure with their own deformation. However, a cold bridge is also formed. The thermal conductivity of steel is 45 w/m·k. The reinforcement in the heat insulation layer has the lowest temperature, and water condensation and freezing may occur on the surface. The heat insulation materials around the reinforcement may freeze and fail, and the cold bridge may continue to increase, forming a vicious circle.

All of the methods for preventing the foundation from frost heaving come at the cost of significant energy consumption. Taking temperature difference correction coefficients on both sides of an enclosure structure as an example, "when there is no heating device such as ventilation under the ground in the cold room, the temperature difference correction coefficient is 0.20, and when there is a ventilated overhead floor, the temperature difference correction coefficient is 0.70." The temperature difference correction coefficient of the latter is 3.5 times that of the former, and this situation persists throughout the service life of the cold store.

The ground heat insulation layer has been subjected to the alternating heavy pressure of a concrete ground, an inner wall, an internal partition wall, goods, and vehicles for a long time, the porosity of the heat insulation material is greatly reduced, the thermal conductivity is greatly improved, and water vapor enters easily but is difficult to escape.

Electric heating of ice through cold storage door cracks consumes both electricity and cold air, and weakens the heat insulation function of the cold storage door. Once a cold storage door catches fire, the flames quickly spread into the heat insulation layer, and quickly burns through the heat insulation layer between the upper and lower cold storage doors, creating its own oxygen supply conditions, causing the fire to spread quickly in the heat insulation layer, and making it difficult to extinguish. A large amount of cold air leaks out, and at the same time, a large amount of high-temperature toxic gases are inhaled, which raises the temperature of the cold store and pollutes food.

BRIEF SUMMARY

Technical Issues

The current design theory of a cold room is as follows. Under normal circumstances, water vapor in the atmosphere penetrates into the cold room through a peripheral protective wall, a leveling layer, a vapor barrier layer, a heat insulation layer and an inner wall, and frosts on an exhaust pipe or an air cooler. Frost has high porosity and low thermal conductivity, which is an obstacle to heat exchange of the exhaust pipe. Water condensation and freezing often occur in the heat insulation layer, especially in a roof the heat insulation layer and a ground heat insulation layer of the cold room in high-temperature and high-humidity areas. It is obvious that with high temperature and high humidity outside the cold room, low temperature and high humidity inside the cold room, and the moisture contained in building materials, water vapor in the heat insulation layer tends to enter easily but is difficult to escape. The roof the heat insulation layer and the ground heat insulation layer are closed in all directions, which sounds very safe. In fact, as long as there is partial pressure difference of water vapor, the penetration of water vapor is inevitable. Where is the escape route for the water vapor that penetrates into the heat insulation layer? Water accumulates more and more.

Some heat insulation layers may also produce harmful gases during construction.

In order to reduce cold bridges, the heat insulation layer of the peripheral protective wall and the column may separate the concrete ground and is integrally connected to the ground heat insulation layer. The inner wall and the internal partition wall are located on the concrete ground (an adhesive layer). During an earthquake, the concrete ground, together with the goods thereon, the inner wall, the internal partition wall, and the like, which are like ships floating on the heat insulation layer, do not vibrate synchronously with a main structure, thereby causing damage to the ground waterproof layer and the heat insulation layer, and leading to water ingress and failure of the heat insulation layer, as well as difficulties in maintenance.

Taking the fireproof performance into account, the peripheral protective wall generally uses brick walls of 240 mm, whose longitudinal stiffness is much greater than that of the main structure, especially for exterior walls without doors. However, the lateral stiffness of the brick wall is very small, and cannot stand independently. There are concrete anchor beams connected to the main structure. During an earthquake, the peripheral protective wall cannot vibrate in coordination with the main structure, often resulting in phenomena such as wall collapse and beam fracture. Recently, some people use reinforcements instead of concrete anchor beams. During an earthquake, reinforcements may produce plastic hinges to coordinate the differential vibration of the structure with their own deformation. However, a cold bridge is also formed. The thermal conductivity of steel is 45 w/m·k. The reinforcement in the heat insulation layer has the lowest temperature, and water condensation and freezing may occur on the surface. The heat insulation materials around the reinforcement may freeze and fail, and the cold bridge may continue to increase, forming a vicious circle.

All of the methods for preventing the foundation from frost heaving come at the cost of significant energy consumption. Taking temperature difference correction coefficients on both sides of an enclosure structure as an example, "when there is no heating device such as ventilation under the ground in the cold room, the temperature difference correction coefficient is 0.20, and when there is a ventilated overhead floor, the temperature difference correction coefficient is 0.70." The temperature difference correction coefficient of the latter is 3.5 times that of the former, and this situation persists throughout the service life of the cold store.

The ground heat insulation layer has been subjected to the alternating heavy pressure of a concrete ground, an inner wall, an internal partition wall, goods, and vehicles for a long time, the porosity of the heat insulation material is greatly reduced, the thermal conductivity is greatly improved, and water vapor enters easily but is difficult to escape.

Electric heating of ice through cold storage door cracks consumes both electricity and cold air, and weakens the heat insulation function of the cold storage door. Once a cold storage door catches fire, the flames quickly spread into the heat insulation layer, and quickly burns through the heat insulation layer between the upper and lower cold storage doors, creating its own oxygen supply conditions, causing the fire to spread quickly in the heat insulation layer, and making it difficult to extinguish. A large amount of cold air leaks out, and at the same time, a large amount of high-temperature toxic gases are inhaled, which raises the temperature of the cold store and pollutes food.

Technical Solution

An objective of the present disclosure is to overcome the shortcomings in the prior art, and provide a green energy-saving cold store which is energy-saving, environment-friendly, excellent in earthquake resistance and fire prevention, low in manufacturing cost, small in temperature fluctuation of the cold store, able to prevent the foundation from frost heaving in an energy-saving method, convenient in maintenance, and capable of controlling the humidity change of relevant parts in real time.

In order to solve the above technical problems, the present disclosure provides a green energy-saving cold store, including a cold room, a platform, a machine room, a refrigeration system and the like, where a drying layer is arranged below a first floor of the cold room, a ground heat insulation layer is moved downwards into the drying layer and is separated from a first floor slab, and an inner wall, an internal partition wall, and a wear-resistant waterproof ground are all directly located on the first floor slab and integrated with a frame structure, where the wear-resistant waterproof ground includes an inorganic wear-resistant system and an organic epoxy system;

the drying layer includes, from bottom to top, a concrete base, a leveling layer, a vapor barrier layer wrapped to the top of a column, and a ground heat insulation layer wrapped to the top of the column, where a height that is of a water vapor channel A and that is under a beam is ≥600 mm, a conveying rope A is arranged under the beam, the conveying rope A is provided with a traction rope, a pulley, a block, a rocking wheel, and a supporting wheel, and a sending end of the conveying rope A is provided with an access hole A which is hermetically sealed by a cover;

a peripheral protective wall uses a light steel structure wall surface, which is connected to the frame structure by a ball joint tie beam at an intersection point between a frame beam and a column, or is connected to the frame structure by a combination of a ball joint wood beam and a drawstring at the intersection point between the frame beam and the column, and no ball joint tie beam is arranged at the corner; a lower part of the light steel structure wall surface is an anti-collision brick wall, and a top surface of the anti-collision brick wall is 1800 mm higher than an outdoor ground; a connection point on a lower part of the steel column of the light steel structure wall surface is a rigid connection point, and an inter-column support is arranged between the steel columns;

an inner side of the color steel plate wall surface is sequentially provided with a fireproof layer, a heat insulation layer, a water vapor channel B, an inner wall, a leveling layer, and a vapor barrier layer; a low-temperature side of the heat insulation layer is provided with a water vapor channel B around the inner wall, the water vapor channel B is separated from the heat insulation layer by a coarse steel mesh and a fine yarn mesh, a conveying rope B is arranged in the water vapor channel B, the conveying rope B is provided with a traction rope, a sliding rail, a block, a pulley, a rocking wheel, and a supporting wheel, both sides of the conveying rope B is provided with an access hole B, and an access hole B is additionally installed every 9 m to 12 m in the middle, which is hermetically sealed by a cover; the water vapor channel B avoids a through-wall pipeline and the ball joint tie beam; a color steel plate seam is hermetically sealed, a self-tapping screw cap is coated with a fireproof coating, a nail hole seam is sealed, and a nailable fire-resistant heat insulation cushion block is arranged between the color steel plate wall surface and a wall purlin; the fireproof layer is leveled with cement mortar at a bottom sealing steel plate and an elevation of a top surface of a top sealing beam, after the mortar is dried, a coating with membrane ductility, low water vapor permeability, firm adhesion to the color steel plate and weather resistance is used as a coating vapor barrier layer, which is hermetically sealed with the color steel plate wall surface, the bottom sealing steel plate, and the top surface of the top sealing beam, the fireproof layer extends 50 mm wider on both sides, respectively, and a welding seam between the bottom sealing steel plate, the top sealing beam and the steel column is hermetically sealed, and is polished smooth;

an attic includes, from bottom to top, a vapor barrier layer, a leveling layer, an attic floor slab, a water vapor channel C in which a concrete cushion block elevates a bamboo mat by a height of 200 mm, a bamboo mat layer, a heat insulation layer, and a top sealing membrane, the top sealing membrane is made of a double-layer PE membrane, the periphery of the top sealing membrane is hermetically sealed with the top sealing beam, and a sealing joint is reinforced with a pressing strip; the water vapor channel C of the attic is provided with a conveying rope C, the conveying rope C is provided with a traction rope, a pulley, a rocking wheel, a supporting wheel, and a trolley, the attic floor slab at both ends of the conveying rope C is provided with an access hole C, a bamboo mat layer on an upper part of the access hole C is further raised by 350 mm, and a surrounding area is enclosed with the bamboo mat;

a color steel plate roof includes a steel grid frame with a geometrically invariant system, or a steel truss with a supporting system, and the color steel plate roof takes the steel column of the light steel structure wall surface as a support, and the steel structure is used as a fireproof protection layer;

a closed platform is used, and a vestibule is arranged in a cold storage room; a cold storage door is arranged on the outer side, the heat insulation layer is externally arranged on one side of the vestibule and matched with an external heat insulation layer of a wall surface and a ceiling to form a complete heat insulation layer; the external heat insulation layer is made of materials which are non-toxic, odorless, non-moisture-retentive or extremely low in moisture absorption rate, low in thermal conductivity, elastic, impact-resistant, and weather-resistant; the external heat insulation layer is coated with non-toxic and odorless silicone oil at a door crack; an airtight fireproof door is arranged on an inner side of the vestibule, a transparent short door curtain is arranged against the wall surface on one side of the vestibule, the short door curtain is 1600 mm long, the top of the vestibule is provided with a top door, which has the functions of fire prevention and smoke prevention; a drying hood with a downward opening is arranged under the ceiling on an upper part of the top door, the opening of the drying hood is aimed at the top door and larger than the top door, a size of the hood is able to accommodate hot and humid air discharged into the cold store by the vestibule, and a desiccant is put into the hood; a wooden bridge spans an external wall heat insulation layer, and a polymer waterproof bridge floor is used; the external wall vapor barrier layer is integrally connected to the inner wall here to enclose the heat insulation layer; the heat insulation layer uses a fireproof and heat-insulating material as an annular fireproof belt here, the annular fireproof belt uses a wooden plate wall surface and a wooden plate ceiling, and brick wall powder of 180 mm is used for other parts of the vestibule;

the cold storage door is of a lifting type, a door leaf of the cold storage door is spliced by a plurality of plastic door plates, a splicing seam is in a circular are shape and is connected into a whole by a connection ring, and adjacent door plates is rotatable in one direction; a lifting rope of the cold storage door is connected to a lower part of the door leaf, the two sides of the door leaf are provided with a single-sided wheel and a groove rail, a lower section of the groove rail is linear, a cross beam connects the groove rails on both sides into a whole, and the groove rails on both sides are rotatable synchronously around an axis of a root; an upper section of the groove rail is curved, and a top end is a horizontal straight line; the upper section of the groove rail is fixed with the cold store, the two sections of the groove rail are butted in the middle to form a complete door leaf operating track, the single-sided wheel operates in the groove rail, the operating speed of the door leaf is controlled by a frequency converter, the cross beam is provided with a spring A and a spring C, a bracket is provided with a spring B, a left end of the spring A is provided with a pin A, and a right end of the spring A is provided with a pin B, a reset position of the pin B is provided with a baffle, the groove rail is provided with a pull ring, the door leaf is provided with a pull hook, the pull hook is matched with the pull ring; the pull hook is arranged on a lower part of the door leaf, the pull ring is arranged on the upper part of the pull hook, and the pull ring is connected to the pin B by a rope;

the ball joint tie beam is a reinforced concrete member with steel ball joint supports at both ends, main reinforcements are interlocked in two loops at the mid-span of the beam without contact with each other, and bear the entire tensile force of the beam, and other longitudinal reinforcements are all dislocated, disconnected and overlapped; the main reinforcements and other longitudinal reinforcements are welded with a head at a beam end; the top of the ball joint support is provided with a hole, through which the main reinforcement passes; there is a gap between the periphery of the main reinforcement and the wall of the hole, the hole is a swing space of the main reinforcement, the size of the hole determines a swing amplitude of the ball joint tie beam; and the cross section of the mid-span is moderately increased;

a drying box consists of a box body, an air duct, a rotating head, an exhaust pipe, and a fin, and is connected to the exhaust pipe; the bottom of the box body is provided with an air inlet, and the front side and back side of the box body are provided with doors; the box body, the door crack, the air duct and the connecting part, and the place where the exhaust pipe enters and exits the box body are all hermetically sealed; a length of the air duct is ≥12 m, a phenolic resin is used for foaming, the rotating head is made of hard plastic with high temperature resistance of 120° C., weather resistance and self-lubrication, and is provided with a guide plate to allow the air outlet to be always leeward; five small wheels and a central shaft form a rotating mechanism, and a friction surface of the central shaft is coated with silicone oil; the box body and the air duct take heat insulation measures, and are fixed by using steel cables; the air duct, the box body, and the exhaust pipe are made into an S-shape in the box body with an oil discharge slope of 0.004, the exhaust pipe and the fin form a drying bed, the fin is made of killed steel, the corners of the upper and lower bed surfaces, both ends and edges are polished, and the top inside the box is provided with an anti-suction net;

a desiccant which is non-toxic, odorless, renewable, non-corrosive to steel and concrete, and highly moisture-retentive is selected, and is put in the appropriate position of the water vapor channel, the vestibule, the cold room and the platform; the desiccant is immediately put into a vapor barrier bag after dehydration, air is exhausted, the vapor barrier bag is sealed and is put on a cooling rack, the cooling rack is first placed in a dry, cool and ventilated place for normal-temperature cooling, and then placed at the wall root opposite the cold storage door for low-temperature cooling;

the vapor barrier bag is made of materials with low water vapor permeability, high thermal conductivity, heat resistance of 130° C. and weather resistance, and the opening is capable of being sealed; and the replaced desiccant is placed into a heat preservation container immediately, and is placed into a lower layer of the drying box as soon as possible;

temperature and humidity sensor transmitters are provided at appropriate positions in the water vapor channel, the drying hood, the platform, and the vestibule, and inside and outside the cold store; a temperature and humidity sensor has the functions of automatic detection, transmission, recording, storage and early warning, and also has the functions of display and printing, and when a line passes through the vapor barrier layer, sealing measures are taken.

In a better embodiment, the heat insulation layer uses waste rice husk and foamed plastic.

In a better embodiment, the mortar for the wear-resistant waterproof ground is formed by mixing cement, quartz sand, silica fume, a water reducer, a defoaming agent, and water, a water consumption is strictly controlled, scrap iron finishes scattering in an initial setting stage, and a non-toxic and odorless cement seal curing agent is sprayed before the final light collection.

In a better embodiment, the heat insulation layer is provided with an annular fireproof belt at the vestibule, and the annular fireproof belt uses a wood substrate and a fire-resistant heat insulation layer; the fire-resistant heat insulation layer is formed by mixing water glass, expanded perlite and rock wool fibers, and is reinforced to the beam, the column and the wood substrate by using a fire-resistant rope; the thermal conductivity of the fire-resistant heat insulation layer material is $\lambda \leq 0.09$ w/m·k, ends of the fire-resistant ropes are knotted and straightened, and sealed with fire-resistant fibers and gypsum paste, and the fireproof layer is formed by mixing gypsum, expanded perlite, slag fibers and water.

In a better embodiment, an external heat insulation layer of the cold storage door uses Cross-linked Polyethylene (XPE) foam, an external heat insulation layer of the wall surface and the ceiling uses an Ethylene-Vinyl Acetate (EVA) foam prefabricated block with a skin; and the external heat insulation layer uses a non-toxic and odorless dye to dye black-and-yellow alternating anti-color-blocking strips without changing flexibility and elasticity of the material.

In a better embodiment, the color steel plate seam uses a sealant with membrane elasticity, firm adhesion to the color steel plate, low water vapor permeability and weather resistance, and is fully scraped flat; after the sealant is dried, the coating with membrane ductility, weather resistance, low water vapor permeability and firm adhesion to the color steel plate and the sealant is applied straddling the seam as a coating vapor barrier layer, the seam extends 30 mm wider on both sides, respectively, a self-tapping screw cap is coated with a fireproof coating, and a nail hole seam is sealed.

In a better embodiment, the bamboo mat uses a beam plate structure, the plate is spliced by bamboo pieces with a gap of 2 mm sandwiched between beams, the beams are alternately glued by bamboo pieces and fiberized bamboo veneers and are reinforced with bamboo nails and galvanized iron wires, and all the used bamboo materials are dewaxed.

In a better embodiment, a ball joint wood beam is used, two ends of the ball joint wood beam are provided with steel spherical supports which are matched with spherical beam ends, and diameters of the spherical supports and the spherical beam ends are slightly larger than a cross-sectional diameter of the wood beam; and the drawstring uses a chemical fiber braided strap with good performance and a steel bracket.

After the structure of the present disclosure is used, the inner wall, the internal partition wall and the wear-resistant waterproof ground are all directly located on the first floor slab and integrated with a frame structure, thus solving the earthquake resistance, waterproofing, and wear resistance problems of the first floor in the cold room, and eliminating the need of the ground waterproof layer, the reinforced concrete bonding layer (ground), and the expensive ground heat insulation layer. The ground heat insulation layer is not under a heavy pressure. The heat insulation material is in the state of natural accumulation with maximum porosity and minimum thermal conductivity, which improves the heat insulation effect of the ground heat insulation layer without considering the compressive strength of the heat insulation material, and also creates technical conditions for thickening the ground heat insulation layer. Thickening the heat insulation layer is the most effective method to save energy, reduce the operating cost of the cold store, stabilize the temperature of the cold store and prevent the foundation from frost heaving, which saves the construction funds invested in preventing the foundation from frost heaving and a lot of energy consumed in the service life of the cold store.

When the volume moisture content of the organic heat insulation material is zero, the porosity decreases from 98% to 96%, and the thermal conductivity increases from 0.03489 w/m·k to 0.053498 w/m·k, which is 53.33% higher.

The ground heat insulation layer moves downwards, and the first floor slab and the beam become the cold storage body in the cold room, which can stabilize the temperature of the cold store.

The light steel structure wall surface has strong deformability, especially out-of-plane deformation, small mass, and small earthquake action. The ball joint tie beam or the ball joint wood beam may swing freely in all directions within the set range. The steel grid frame has small mass, small earthquake action, and strong deformability, and may not collapse even if individual members have plastic hinges.

Combining the light steel structure wall surface, the ball joint tie beam, and the steel grid frame, the cold store building can coordinate the vibration during an earthquake (in fact, the light steel structure wall surface and the color steel plate roof obey the vibration of the frame structure), which improves the earthquake resistance of the cold store building.

In the heat insulation layer, the water vapor channel has low temperature and high humidity, which is the best place for a desiccant to function. A color steel plate is vapor-impermeable, and the joint between plates is very small. Assuming that the joint length is 4000 m (the corresponding wall surface is about 2660 m2), the joint width is 0.2 mm, and the water vapor penetration area is =4000×0.0002=0.8 m2. Additionally, the width of the sealant membrane is equal to the thickness of the vapor-permeable sealant membrane, which is 20 mm. There is also a barrier of the coating vapor barrier layer. Thus, the water vapor penetration intensity is extremely low for the entire wall surface. The top sealing membrane is made of a double-layer PE membrane, which reduces the penetration intensity by half. The water vapor permeability of rice husk is high. Dewaxing of bamboo materials used in the bamboo mat improves the water vapor permeability. At 20° C., the drying effect of a silica gel is 0.006 g/m3 of residual water vapor, and the moisture absorption of the silica gel is stronger at −20° C., which is beneficial to drying the heat insulation layer. In this way, the heat insulation layer can be kept in a very dry state, and the actual thermal conductivity of the heat insulation material is lower than the designed thermal conductivity. The thermal conductivity of water is 20 times higher than that of air, and the thermal conductivity of ice is 80 times higher than that of air, which improves the heat insulation effect of the heat insulation layer and reduces the operating cost of the cold store. The drying hood can dry hot wet air entering the cold store, slow down the frost rate of the exhaust pipe, and reduce the number of defrosting times.

Use of the color steel plate roof and the steel grid frame eliminates all cold bridges on the roof (the reinforced concrete column passes through the roof heat insulation layer), saves a lot of energy, and reduces the operating cost of the cold store.

A closed platform is used, which limits the exchange of cold and hot air, reduces energy loss, slows down the frosting rate of the exhaust pipe, and creates conditions for preventing the door crack from freezing.

The drying box uses the waste heat of the high-temperature working medium as the desiccant to dehydrate and cool the working medium, which no longer consumes energy, achieves triple-effect energy-saving, and reduces the operating cost of the cold store.

When the cold storage door is closed, the top door and the fireproof door may automatically open, and the cold air in the cold store may flow into the vestibule from the fireproof door, which is blocked by a short door curtain at the top. The hot air in the vestibule may rush out from the top door conveniently and enter the drying hood, bypassing an upward opening of the top door (the door crack). The hot air may stay in the vestibule for a very short time (in seconds), and the wall surface freezes a little, which may be absorbed by the desiccant. The vestibule may stay in a dry state. The fireproof door crack and the top door crack may not freeze. The cold storage door crack is in the normal temperature area.

The heat insulation layer uses waste rice husk and foamed plastic, which reduces environmental pollution, reduces the project cost, and has no raw material, energy, labor and environmental pollution due to the production of the heat insulation material.

No toxic gas is produced in the construction process of rice husk.

The purchase price of waste polystyrene foam plastic is 0.8 yuan/kg. Rice husk and other foam plastic are not purchased, which reduces the project cost, reduces environmental pollution, and creates economic conditions for thickening the heat insulation layer. The temperature and humidity sensor can control the temperature and humidity change of relevant parts and the water vapor permeability law in real time, and the desiccant is replaced as appropriate. Main reinforcements of the ball joint tie beam are interlocked in two loops without contact with each other, and other longitudinal reinforcements are all dislocated, disconnected and overlapped. There is no longitudinal through reinforcement in the entire beam, so that the effect of the cold bridge is greatly reduced. The thermal conductivity of ball joint wood beam is lower.

Beneficial Effects

After the structure of the present disclosure is used, the inner wall, the internal partition wall and the wear-resistant waterproof ground are all directly located on the first floor slab and integrated with a frame structure, thus solving the earthquake resistance, waterproofing, and wear resistance problems of the first floor in the cold room, and eliminating the need of the ground waterproof layer, the reinforced concrete bonding layer (ground), and the expensive ground heat insulation layer. The ground heat insulation layer is not under a heavy pressure. The heat insulation material is in the state of natural accumulation with maximum porosity and minimum thermal conductivity, which improves the heat insulation effect of the ground heat insulation layer without considering the compressive strength of the heat insulation material, and also creates technical conditions for thickening the ground heat insulation layer. Thickening the heat insulation layer is the most effective method to save energy, reduce the operating cost of the cold store, stabilize the temperature of the cold store and prevent the foundation from frost heaving, which saves the construction funds invested in preventing the foundation from frost heaving and a lot of energy consumed in the service life of the cold store.

When the volume moisture content of the organic heat insulation material is zero, the porosity decreases from 98% to 96%, and the thermal conductivity increases from 0.03489 w/m·k to 0.053498 w/m·k, which is 53.33% higher.

The ground heat insulation layer moves downwards, and the first floor slab and the beam become the cold storage body in the cold room, which can stabilize the temperature of the cold store.

The light steel structure wall surface has strong deformability, especially out-of-plane deformation, small mass, and small earthquake action. The ball joint tie beam or the ball joint wood beam may swing freely in all directions within the set range. The steel grid frame has small mass, small earthquake action, and strong deformability, and may not collapse even if individual members have plastic hinges. Combining the light steel structure wall surface, the ball joint tie beam, and the steel grid frame, the cold store building can coordinate the vibration during an earthquake (in fact, the light steel structure wall surface and the color steel plate roof obey the vibration of the frame structure), which improves the earthquake resistance of the cold store building.

In the heat insulation layer, the water vapor channel has low temperature and high humidity, which is the best place for a desiccant to function. A color steel plate is vapor-impermeable, and the joint between plates is very small. Assuming that the joint length is 4000 m (the corresponding wall surface is about 2660 m2), the joint width is 0.2 mm, and the water vapor penetration area is =4000×0.0002=0.8 m2. Additionally, the width of the sealant membrane is equal to the thickness of the vapor-permeable sealant membrane, which is 20 mm. There is also a barrier of the coating vapor barrier layer. Thus, the water vapor penetration intensity is extremely low for the entire wall surface. The top sealing membrane is made of a double-layer PE membrane, which reduces the penetration intensity by half. The water vapor permeability of rice husk is high. Dewaxing of bamboo materials used in the bamboo mat improves the water vapor permeability. At 20° C., the drying effect of a silica gel is 0.006 g/m3 of residual water vapor, and the moisture absorption of the silica gel is stronger at −20° C., which is beneficial to drying the heat insulation layer. In this way, the heat insulation layer can be kept in a very dry state, and the actual thermal conductivity of the heat insulation material is lower than the designed thermal conductivity. The thermal conductivity of water is 20 times higher than that of air, and the thermal conductivity of ice is 80 times higher than that of air, which improves the heat insulation effect of the heat insulation layer and reduces the operating cost of the cold store. The drying hood can dry hot wet air entering the cold store, slow down the frost rate of the exhaust pipe, and reduce the number of defrosting times.

Use of the color steel plate roof and the steel grid frame eliminates all cold bridges on the roof (the reinforced concrete column passes through the roof heat insulation layer), saves a lot of energy, and reduces the operating cost of the cold store.

A closed platform is used, which limits the exchange of cold and hot air, reduces energy loss, slows down the frosting rate of the exhaust pipe, and creates conditions for preventing the door crack from freezing.

The drying box uses the waste heat of the high-temperature working medium as the desiccant to dehydrate and cool the working medium, which no longer consumes energy, achieves triple-effect energy-saving, and reduces the operating cost of the cold store.

When the cold storage door is closed, the top door and the fireproof door may automatically open, and the cold air in the cold store may flow into the vestibule from the fireproof door, which is blocked by a short door curtain at the top. The hot air in the vestibule may rush out from the top door conveniently and enter the drying hood, bypassing an upward opening of the top door (the door crack). The hot air may stay in the vestibule for a very short time (in seconds), and the wall surface freezes a little, which may be absorbed by the desiccant. The vestibule may stay in a dry state. The fireproof door crack and the top door crack may not freeze. The cold storage door crack is in the normal temperature area.

The heat insulation layer uses waste rice husk and foamed plastic, which reduces environmental pollution, reduces the project cost, and has no raw material, energy, labor and environmental pollution due to the production of the heat insulation material.

No toxic gas is produced in the construction process of rice husk.

The purchase price of waste polystyrene foam plastic is 0.8 yuan/kg. Rice husk and other foam plastic are not purchased, which reduces the project cost, reduces environmental pollution, and creates economic conditions for thickening the heat insulation layer. The temperature and humidity sensor can control the temperature and humidity change of relevant parts and the water vapor permeability law in real time, and the desiccant is replaced as appropriate. Main reinforcements of the ball joint tie beam are interlocked in two loops without contact with each other, and other longitudinal reinforcements are all dislocated, disconnected and overlapped. There is no longitudinal through reinforcement in the entire beam, so that the effect of the cold bridge is greatly reduced. The thermal conductivity of ball joint wood beam is lower.

BRIEF DESCRIPTION OF THE DRAWINGS

In FIG. 22-FIG. 27, the conveying rope A is provided with a first traction rope (61A), a first sliding rail (63A), a first pulley (66A), a first block (65A), a first rocking wheel (64A), and a first supporting wheel (68A); the conveying rope B is provided with a second traction rope (61B), a second sliding rail (63B), a second block (65B), a second pulley (66B), a second rocking wheel (64B), and a second supporting wheel (68B), and the conveying rope C is provided with a third traction rope (61C), a third pulley (66C), a third rocking wheel (64C), a third supporting wheel (68C), and a third trolley (69C).

DETAILED DESCRIPTION OF THE DRAWINGS AND THE PRESENTLY PREFERRED EMBODIMENTS

Figure 1:
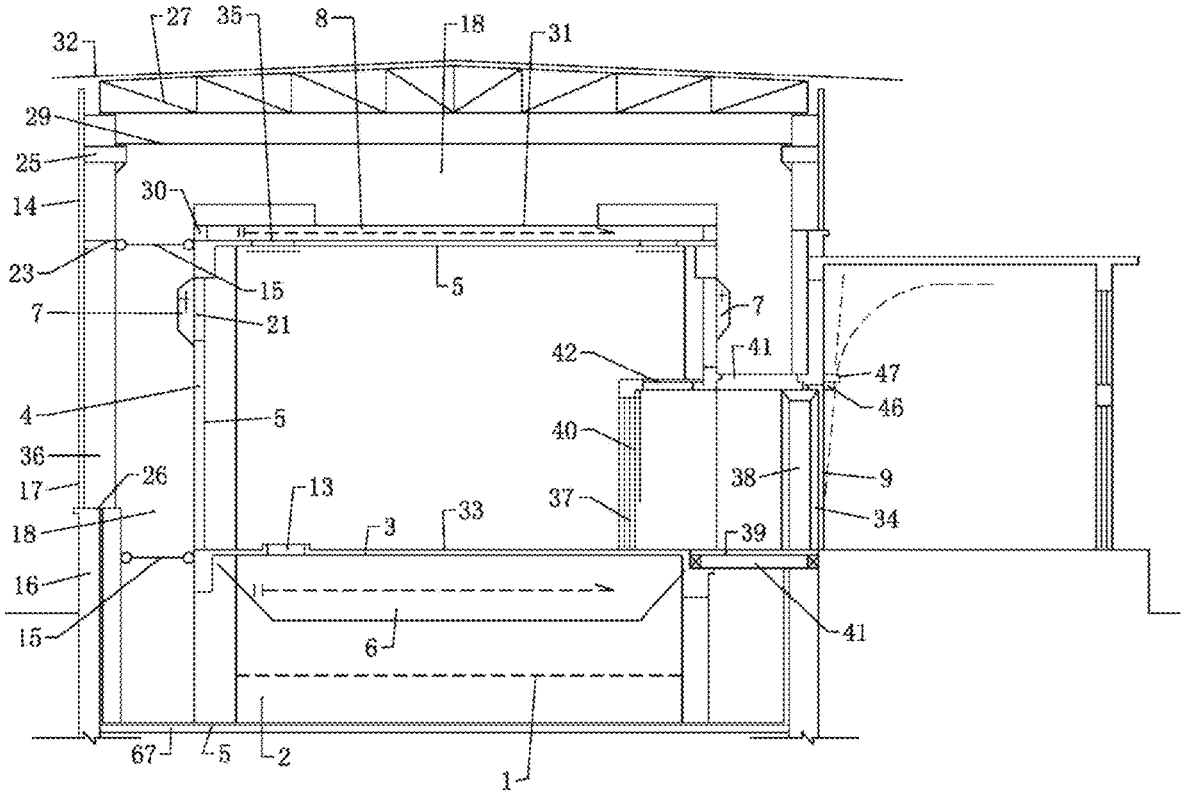
FIG. 1 is a schematic diagram of a green energy-saving cold store according to the present disclosure.
Figure 2:
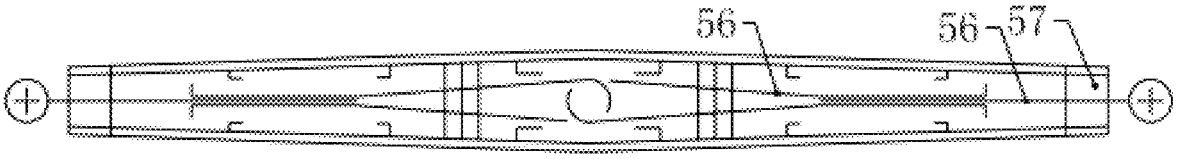
FIG. 2 is a schematic diagram of a ball joint tie beam according to the present disclosure.
Figure 3:
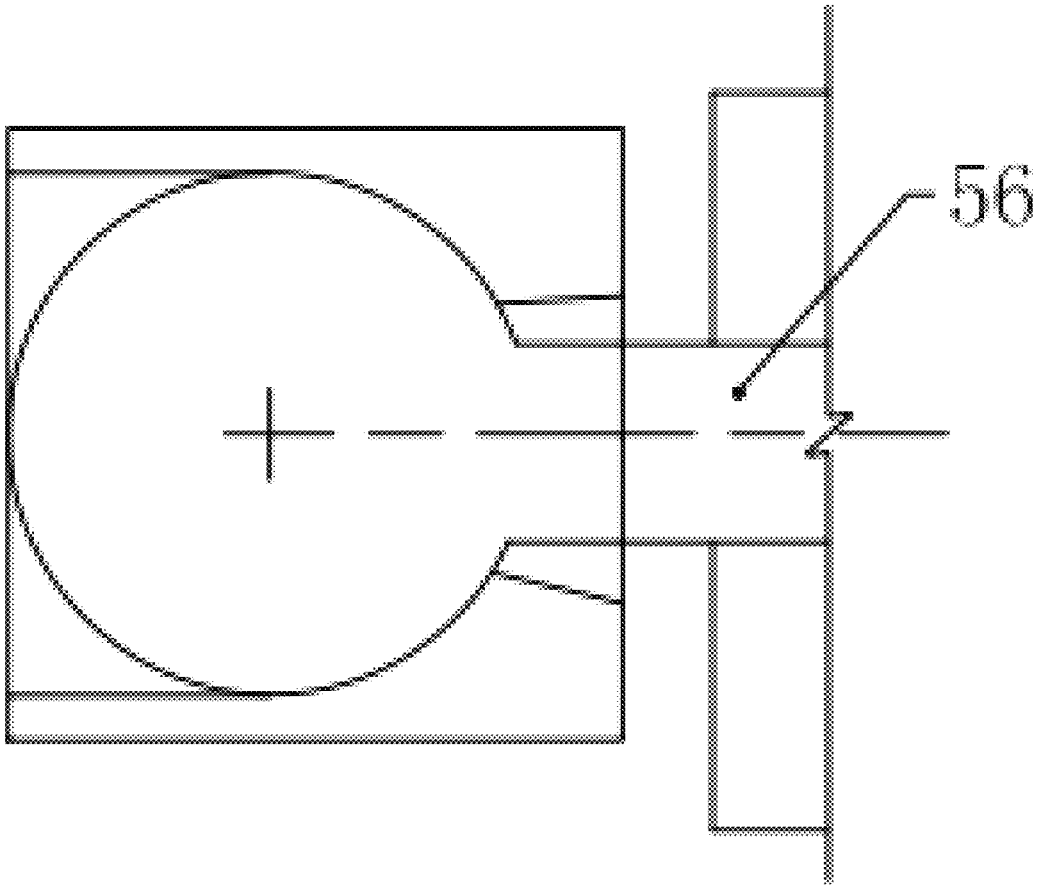
FIG. 3 is a cross-sectional diagram of a ball joint support according to the present disclosure.
Figure 4:
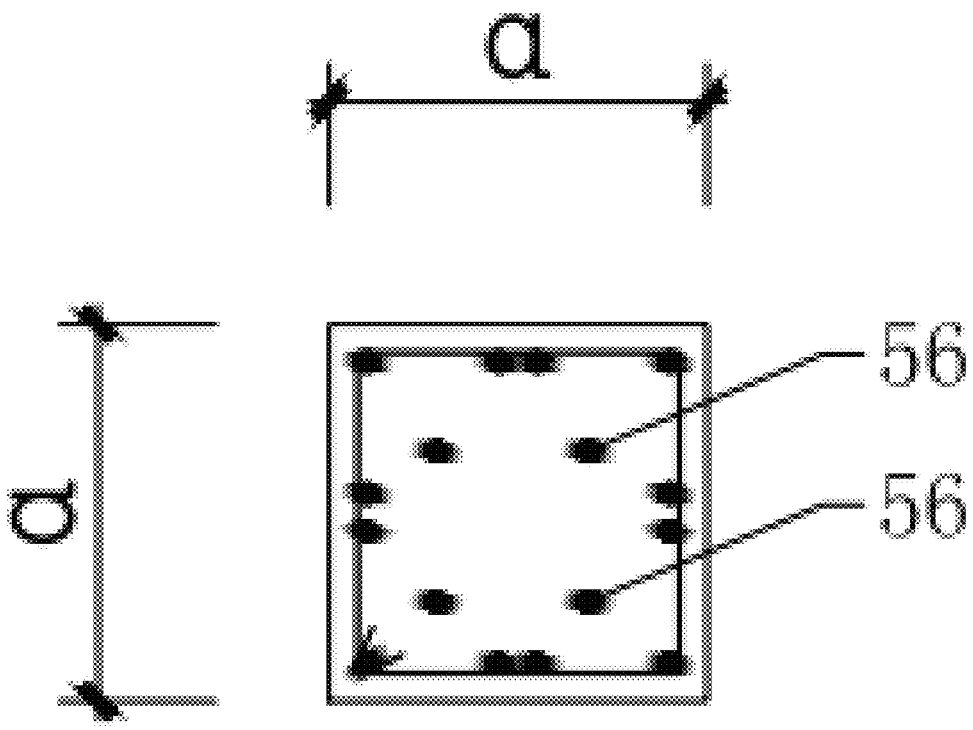
FIG. 4 is a cross-sectional diagram of a ball joint tie beam according to the present disclosure.
Figure 5:
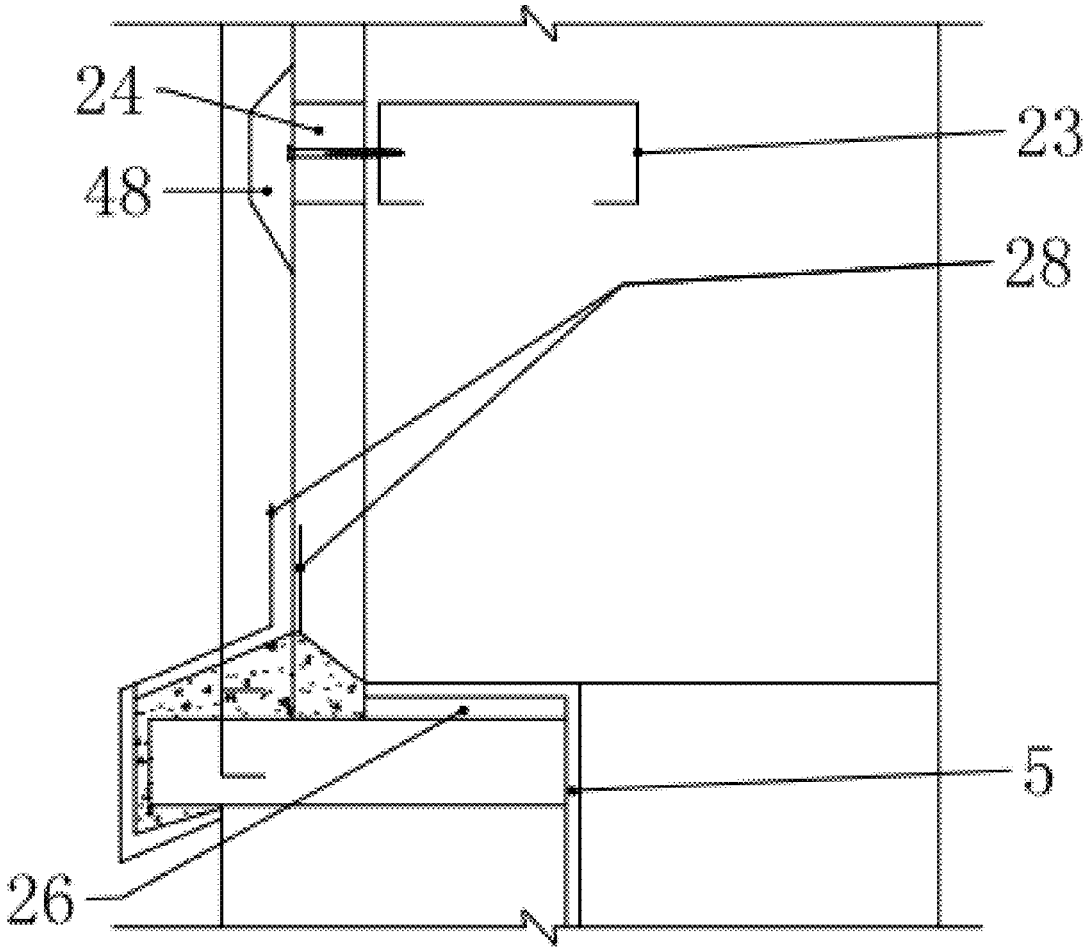
FIG. 5 is a schematic diagram of the connection between a light steel structure wall surface and an anti-collision brick wall.
Figure 6:
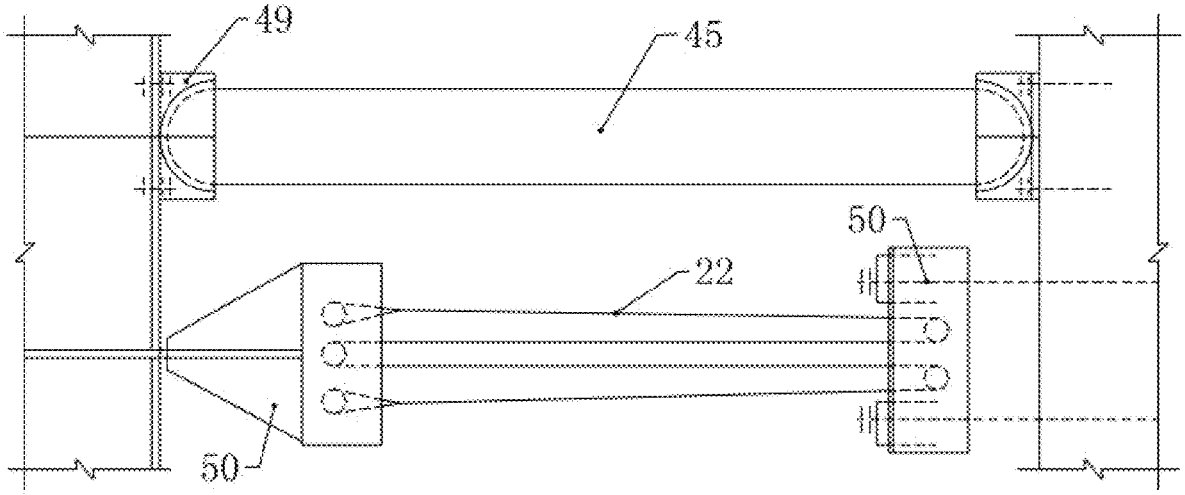
FIG. 6 is a schematic diagram of the combination of a ball joint wood beam and a drawstring according to the present disclosure.
Figure 7:
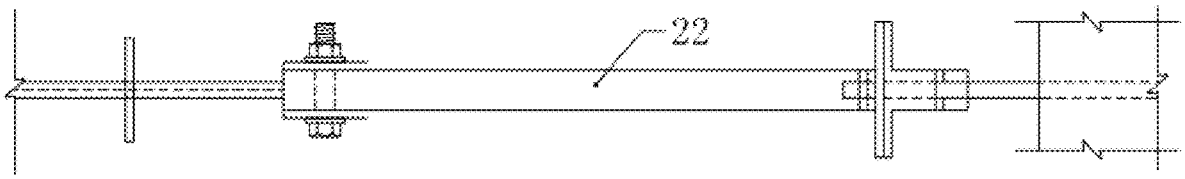
FIG. 7 is a schematic diagram of a drawstring according to the present disclosure.
Figure 8:
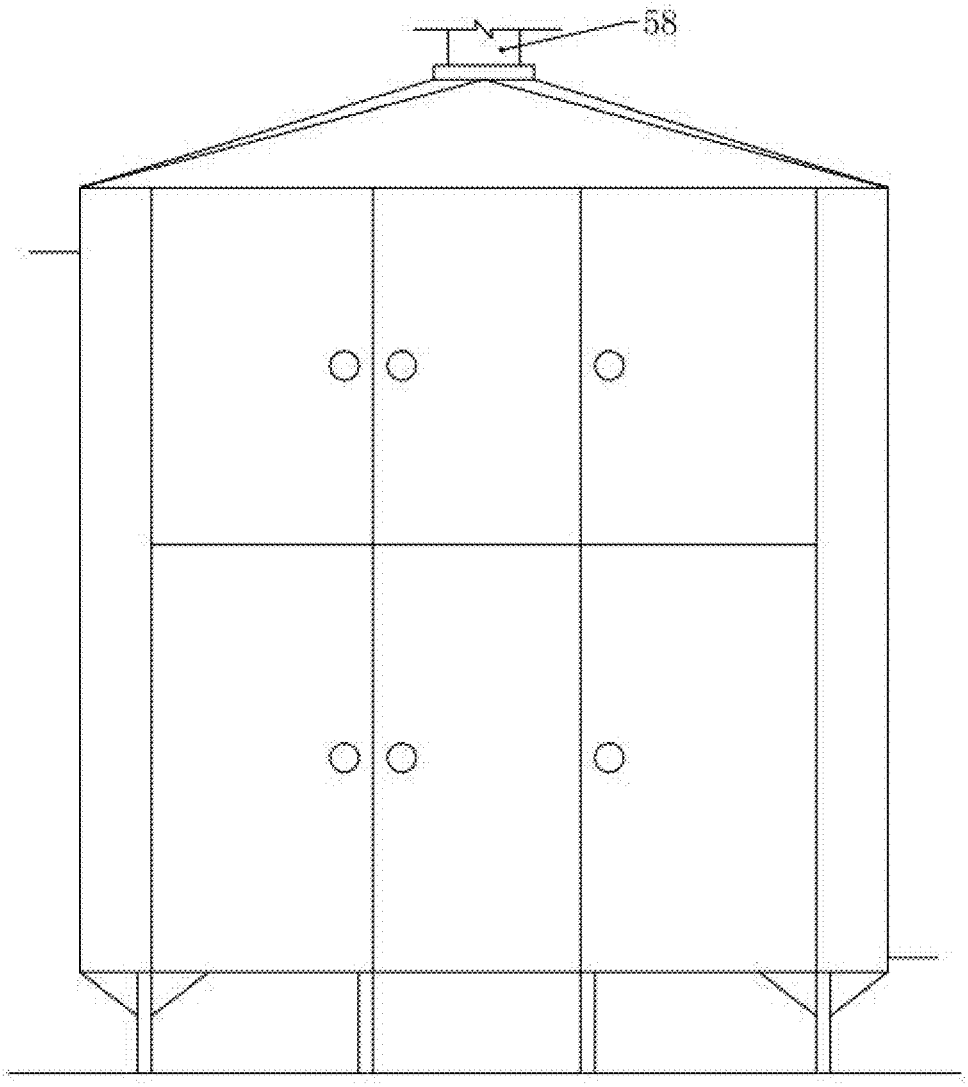
FIG. 8 is a schematic diagram of a drying box according to the present disclosure.
Figure 9:
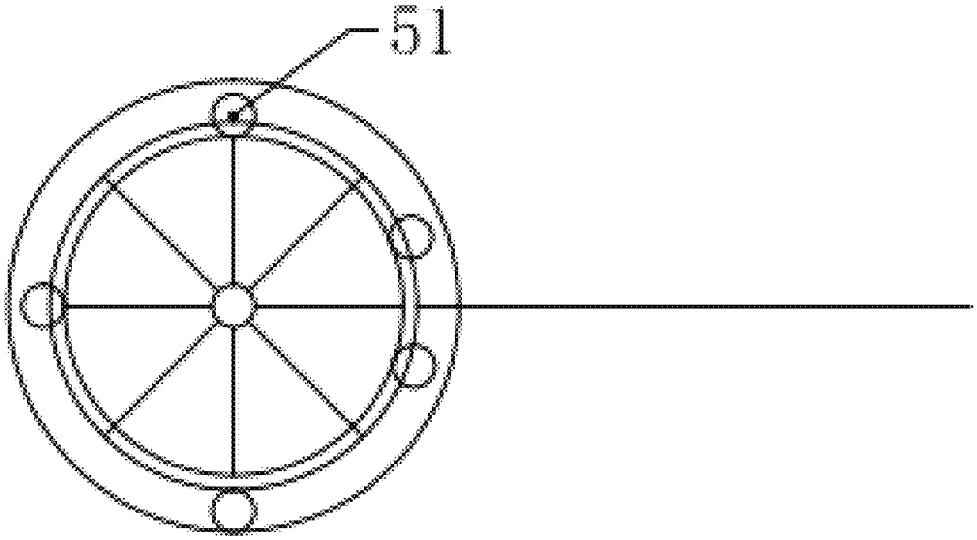
FIG. 9 is a cross-sectional diagram of a rotating head of a drying box according to the present disclosure.
Figure 10:
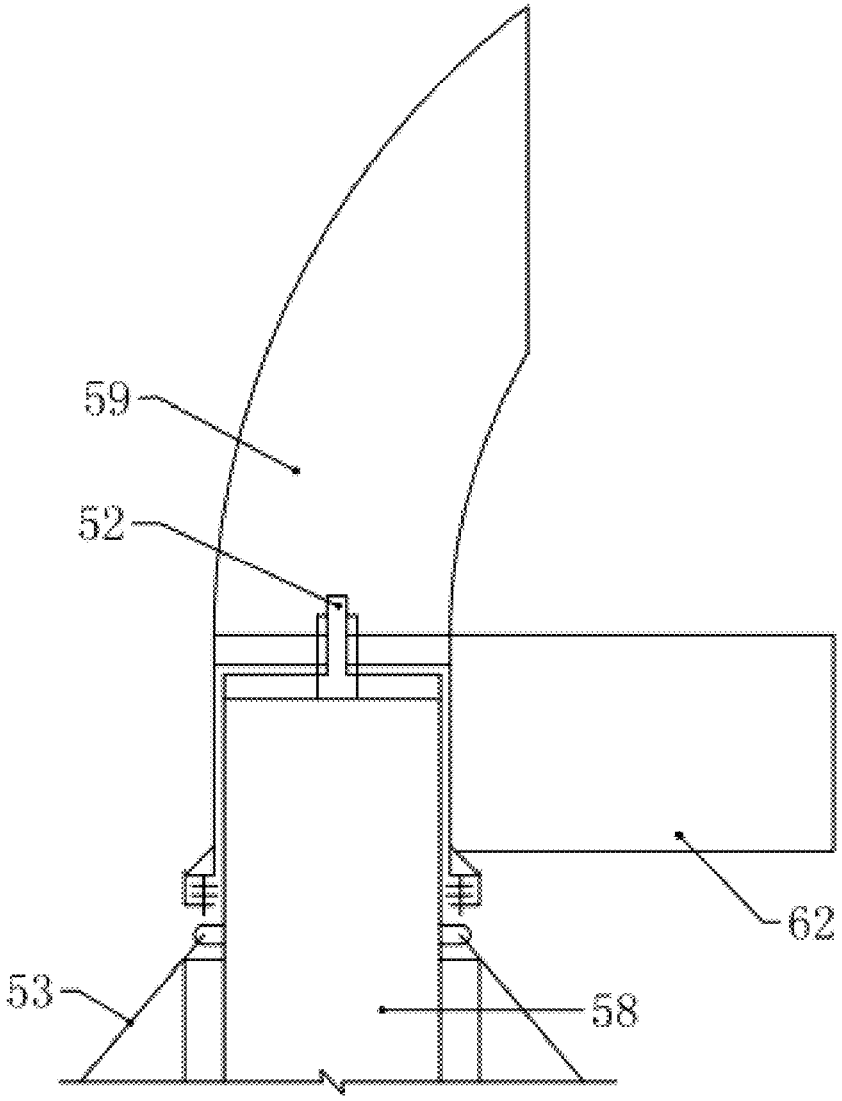
FIG. 10 is a schematic diagram of a rotating head according to the present disclosure.
Figure 11:
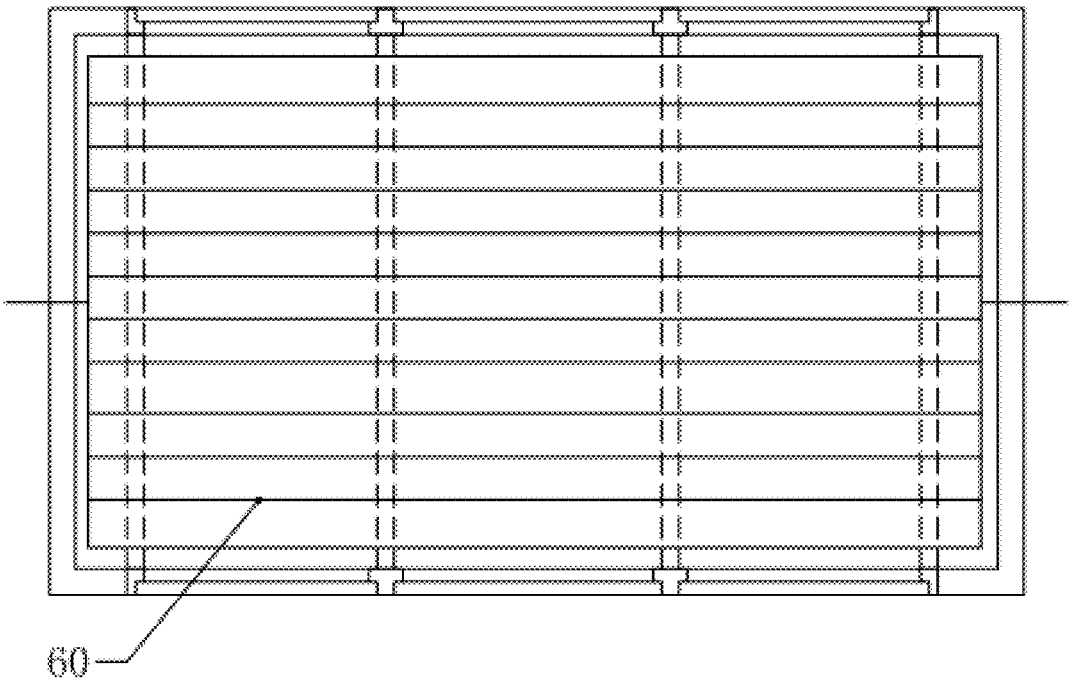
FIG. 11 is a layout diagram of an exhaust pipe in a drying box according to the present disclosure.
Figure 12:
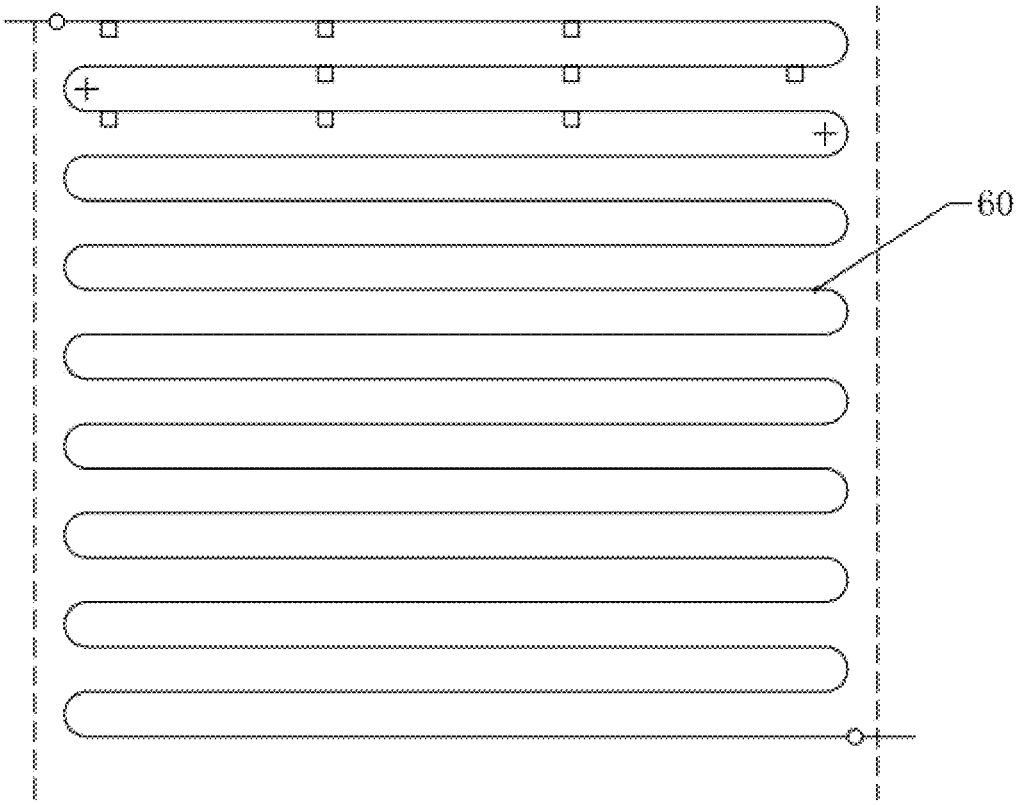
FIG. 12 is a front view of an exhaust pipe in a drying box according to the present disclosure.
Figure 13:
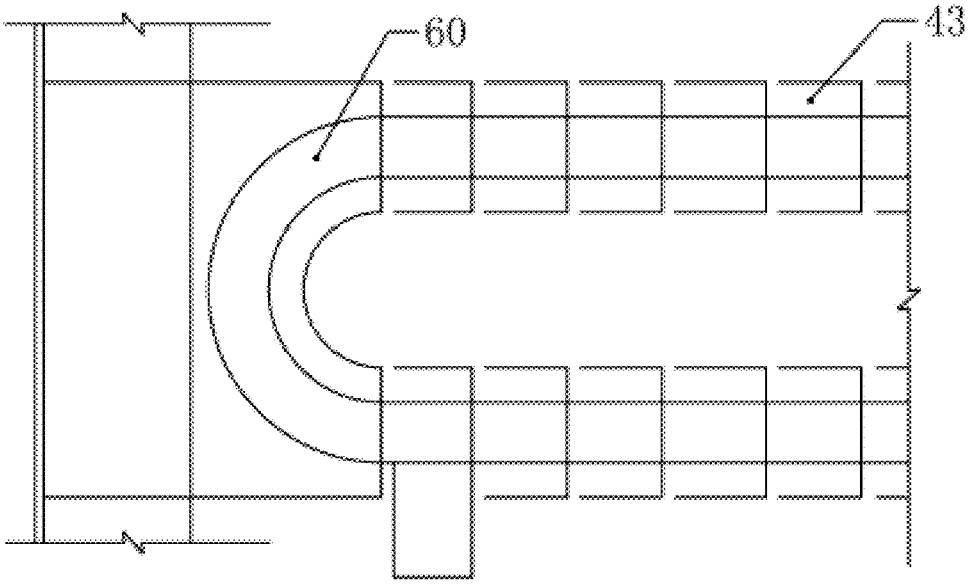
FIG. 13 is a partial cross-sectional diagram of a drying bed according to the present disclosure.
Figure 14:
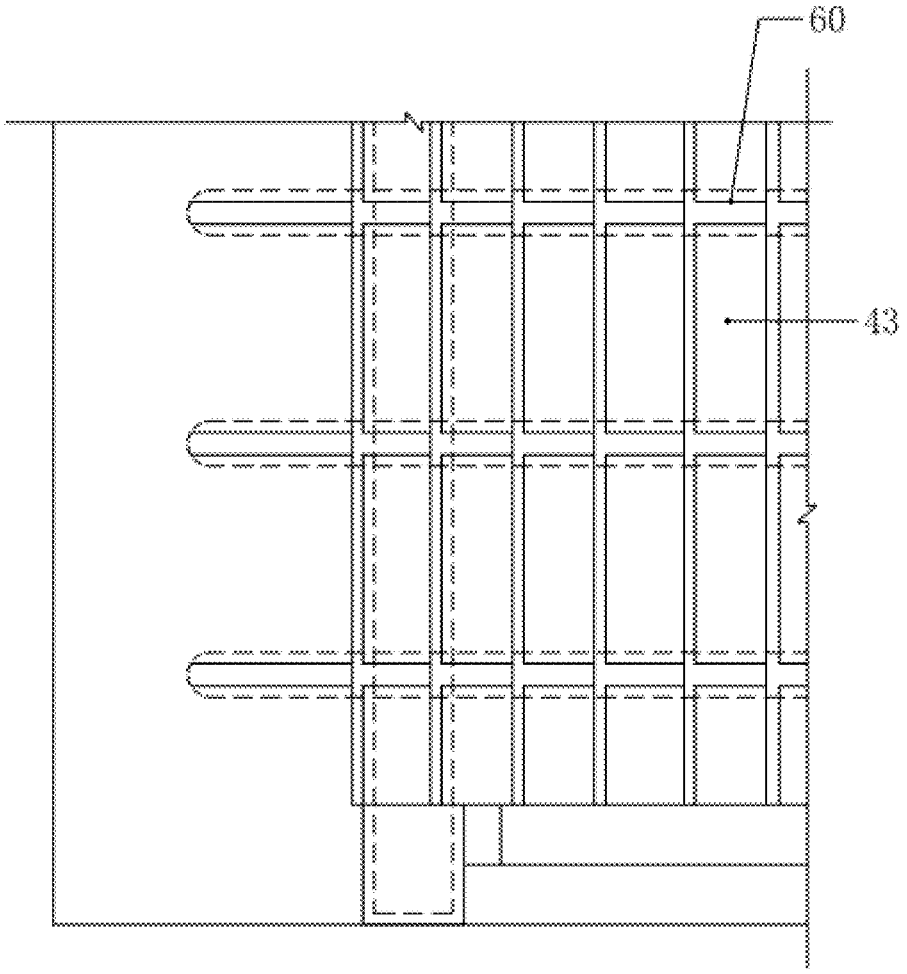
FIG. 14 is a partial top view of a drying bed according to the present disclosure.
Figure 15:
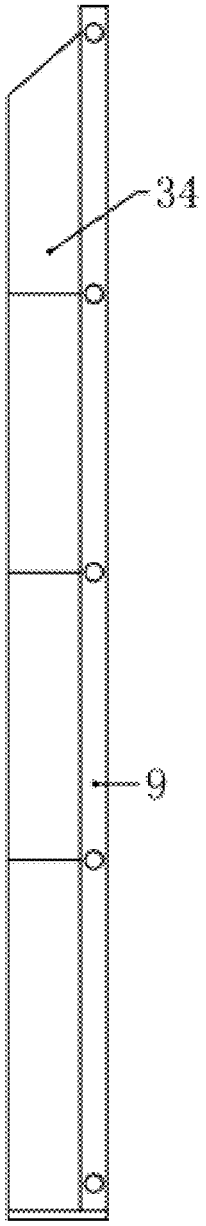
FIG. 15 is a schematic diagram of a cold storage door according to the present disclosure.
Figure 16:
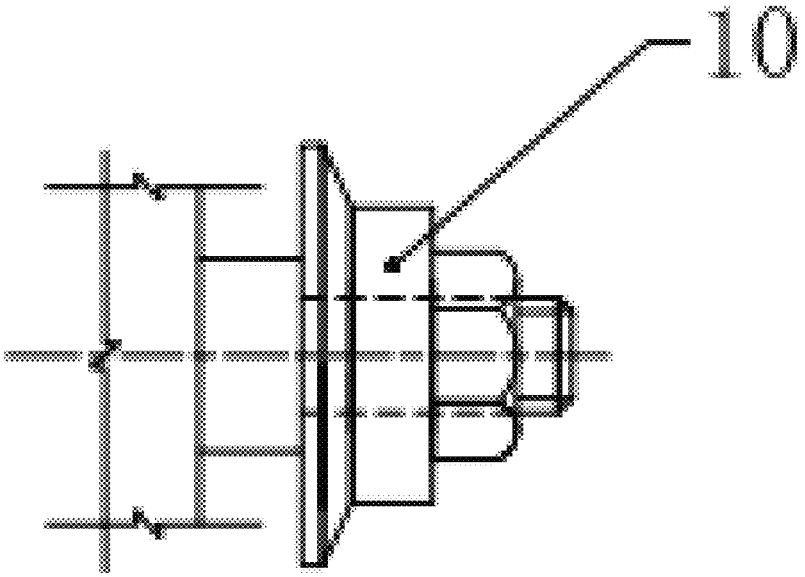
FIG. 16 is a schematic diagram of a single-sided wheel in an upper part of a cold storage door according to the present disclosure.
Figure 17:
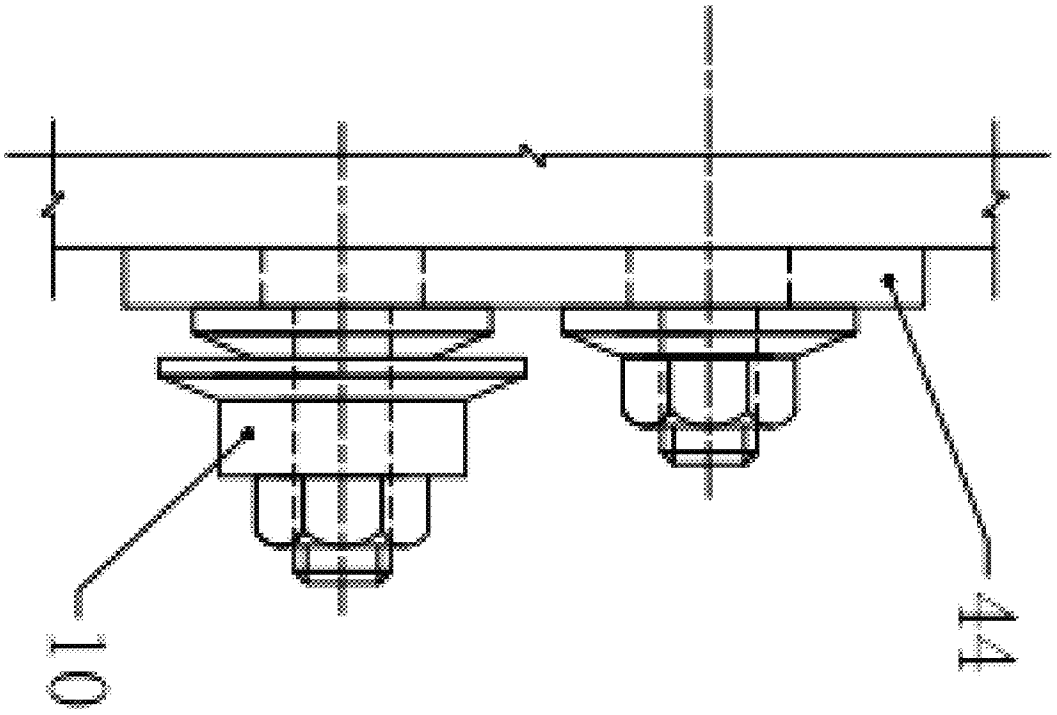
FIG. 17 is a schematic diagram of a single-sided wheel in a middle part of a cold storage door according to the present disclosure.
Figure 18:
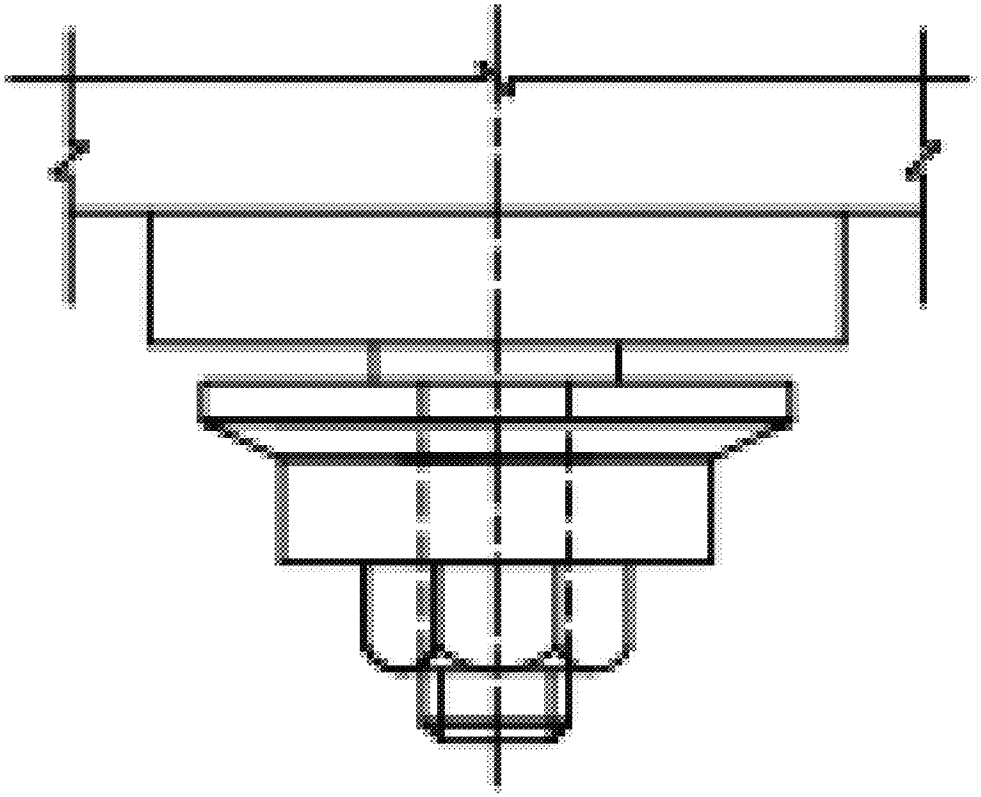
FIG. 18 is a schematic diagram of a single-sided wheel in a lower part of a cold storage door according to the present disclosure.
Figure 19:
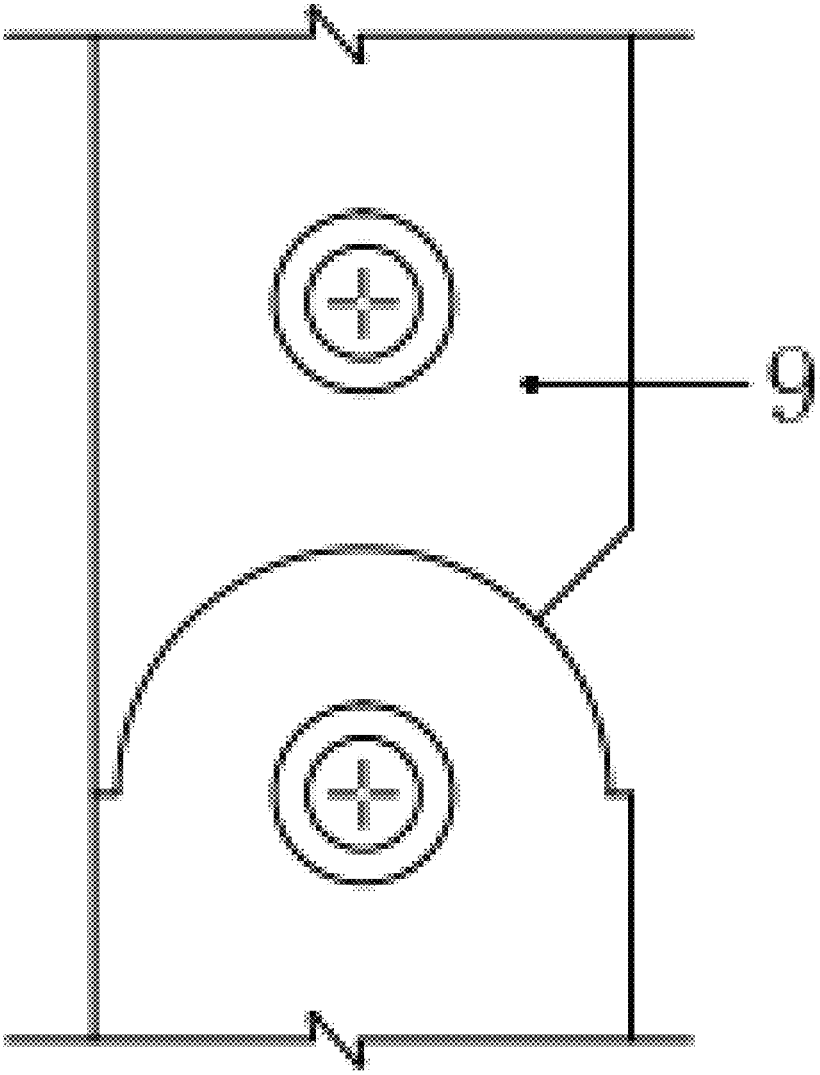
FIG. 19 is a schematic diagram of a connection seam of a cold storage door plate according to the present disclosure.
Figure 20:
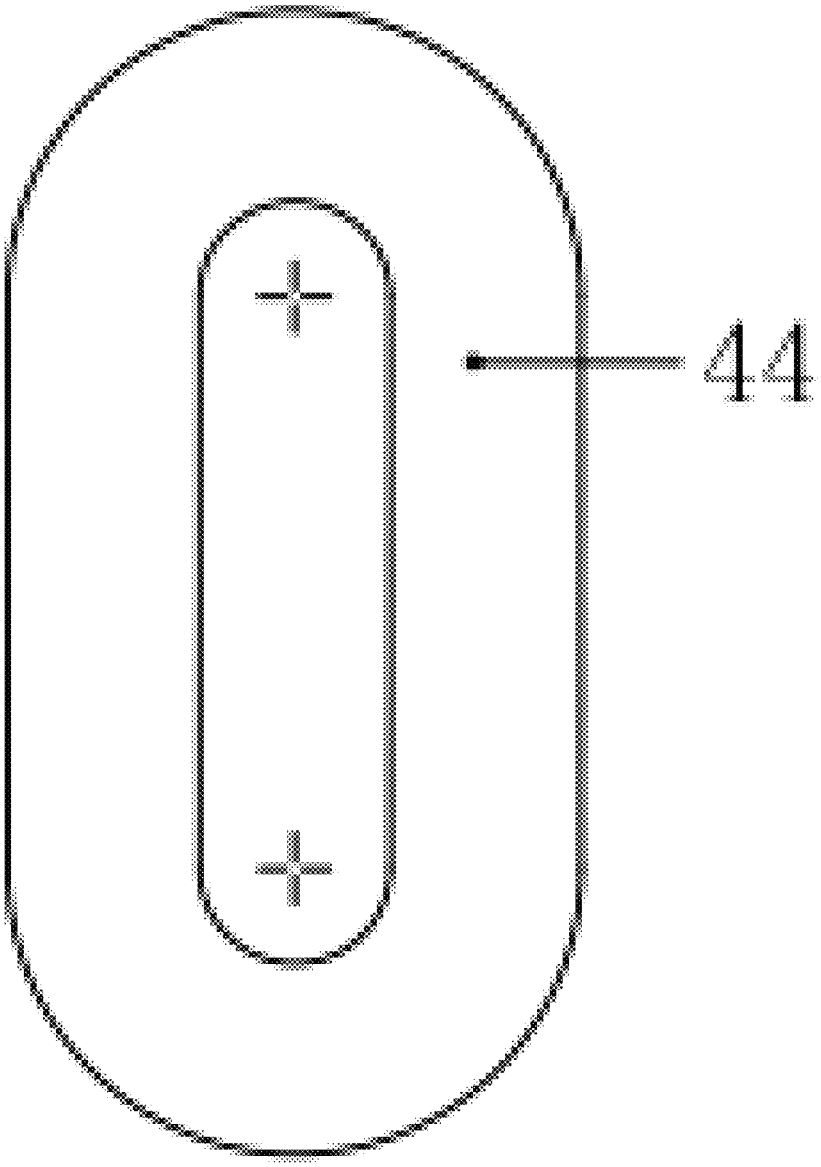
FIG. 20 is a schematic diagram of a connection ring of a cold storage door plate according to the present disclosure.

The present disclosure will be further described with reference to the attached drawings and specific embodiments.

Referring to FIG. 1 to FIG. 40, a green energy-saving cold store includes a cold room, a platform, a machine room, a refrigeration system. A drying layer 1 is arranged below a first floor of the cold room. A ground heat insulation layer 2 is moved downwards into the drying layer 1 and is separated from a first floor slab 3. An inner wall 4, an internal partition wall, and a wear-resistant waterproof ground 33 are all directly located on the first floor slab 3 and integrated with a frame structure. The wear-resistant waterproof ground 33 includes an inorganic wear-resistant system and an organic epoxy system. The drying layer 1 includes, from bottom to top, a concrete base 67, a leveling layer, a vapor barrier layer 5 wrapped to the top of a column, and a ground heat insulation layer 2 wrapped to the top of the column. A height that is of a water vapor channel A 6 and that is under a beam is ≥600 mm. A conveying rope A is arranged under the beam. The conveying rope A is provided with a first traction rope 61A, a first sliding rail 63A, a first pulley 66A, a first block 65A, a first rocking wheel 64A, and a first supporting wheel 68A. A first floor slab at a sending end of the conveying rope A is provided with an access hole A 13 which is hermetically sealed by a cover. The block is hung properly, and the desiccant is placed into the sliding rail 63 and is fixed with the traction rope. The rocking wheel 64 is rotated to send out the block . . . . The rocking wheel is reversed, so that the block returns, the block is removed, and the desiccant is replaced . . . . The access hole is provided based on the principle of facilitating desiccant replacement and maintenance, maximizing shared use as much as possible, and taking waterproofing into account.

A peripheral protective wall uses a light steel structure wall surface 14, which is connected to the frame structure by a ball joint tie beam 15 at an intersection point between a frame beam and a column, or is connected to the frame structure by a combination of a ball joint wood beam 45 and a drawstring 22 at the intersection point between the frame beam and the column. No ball joint tie beam 15 is arranged at the corner. A lower part of the light steel structure wall surface 14 is an anti-collision brick wall 16, and a top surface of the anti-collision brick wall is 1800 mm higher than an outdoor ground.

An inner side of the color steel plate wall surface is sequentially provided with a fireproof layer 17, a heat insulation layer 18, a water vapor channel B 7, an inner wall 4, a leveling layer, and a vapor barrier layer 5. A low-temperature side of the heat insulation layer 18 is provided with a water vapor channel B 7 around the inner wall 4. The water vapor channel B 7 is separated from the heat insulation layer 18 by a coarse steel mesh and a fine yarn mesh. A conveying rope B is arranged in the water vapor channel B 7. The conveying rope B is provided with a second traction rope 61B, a second sliding rail 63B, a second block 65B, a second pulley 66B, a second rocking wheel 64B, and a second supporting wheel 68B. The operation method is the same as that of the conveying rope A. The water vapor channel B 7 avoids a through-wall pipeline and the ball joint tie beam 15. A color steel plate seam and a nail hole seam are hermetically sealed, and a nailable fire-resistant heat insulation cushion block 24 is arranged between the color steel plate wall surface and a wall purlin 23. The fireproof layer 17 is leveled with cement mortar at a bottom sealing steel plate 26 and an elevation of a top surface of a top sealing beam 25. After the mortar is dried, a coating with membrane ductility, low water vapor permeability, firm adhesion to the color steel plate and weather resistance is used as a coating vapor barrier layer 28, which is hermetically sealed with the color steel plate wall surface, the bottom sealing steel plate 26, and the top surface of the top sealing beam 25. The fireproof layer 17 extends 50 mm wider on both sides, respectively. A welding seam between the bottom sealing steel plate 26, the top sealing beam 25 and the steel column 36 is hermetically sealed, and is polished smooth without sharp corners or burrs. The vapor barrier layer 5 of the anti-collision brick wall 16 is hermetically sealed with the bottom sealing steel plate 26. When selecting the anticorrosion coating for the top sealing beam 25, the adhesion to the PE membrane and the coating vapor barrier layer 28 should be taken into account.

An attic includes, from bottom to top, a vapor barrier layer 5, a leveling layer, an attic floor slab, a water vapor channel C 8 in which a concrete cushion block 30 elevates a bamboo mat by a height of 200 mm, a bamboo mat layer 31, a heat insulation layer 18, and a top sealing membrane 29. The periphery of the top sealing membrane 29 is hermetically sealed with the top sealing beam, and a sealing joint is reinforced with a pressing strip. The water vapor channel C 8 of the attic is provided with a conveying rope C. The conveying rope C is provided with a third traction rope 61C, a third pulley 66C, a third rocking wheel 64C, a third supporting wheel 68C, and a third trolley 69C.The use method of the conveying rope C is as follows: the trolley 69 is filled with a desiccant and is fixed with the traction rope 61. The rocking wheel 64 is rotated to send out the trolley 69 . . . . The rocking wheel 64 is reversed, so that the trolley 69 returns, and the desiccant is replaced . . . . The attic floor slab at both ends of the conveying rope C is provided with an access hole C 35 which is hermetically sealed by a cover. A bamboo mat layer on an upper part of the access hole C 35 is further raised by 350 mm, and a surrounding area is enclosed with the bamboo mat.

A color steel plate roof 32 includes a steel grid frame 27 with a geometrically invariant system, or a steel truss and a supporting system. The color steel plate roof 32 takes the steel column 36 of the light steel structure wall surface 14 as a support, and the steel structure is used as a fireproof protection layer.

A closed platform is used, and a vestibule is arranged in a cold storage room. A cold storage door 9 is arranged on the outer side. The heat insulation layer 34 is externally arranged on one side of the vestibule and matched with an external heat insulation layer 38 of a wall surface and a ceiling to form a complete heat insulation layer. The external heat insulation layer is made of materials which are non-toxic, odorless, non-moisture-retentive or extremely low in moisture absorption rate, low in thermal conductivity, elastic, impact-resistant, and weather-resistant. An airtight fireproof door 37 is arranged on an inner side of the vestibule. A transparent short door curtain 40 is arranged against the wall surface on one side of the vestibule. The short door curtain 40 is 1600 mm long. The top of the vestibule is provided with a top door 42, which has the functions of fire prevention and smoke prevention. A wooden bridge 39 spans an external wall heat insulation layer 18, and a polymer waterproof bridge floor is used. The external wall vapor barrier layer is integrally connected to the inner wall here to enclose the heat insulation layer. The heat insulation layer is used as an annular fireproof belt 41 here. The annular fireproof belt 41 uses a wooden plate wall surface 7 and a wooden plate ceiling 74. Brick wall powder of 180 mm is used for other parts of the vestibule.

Figure 21:
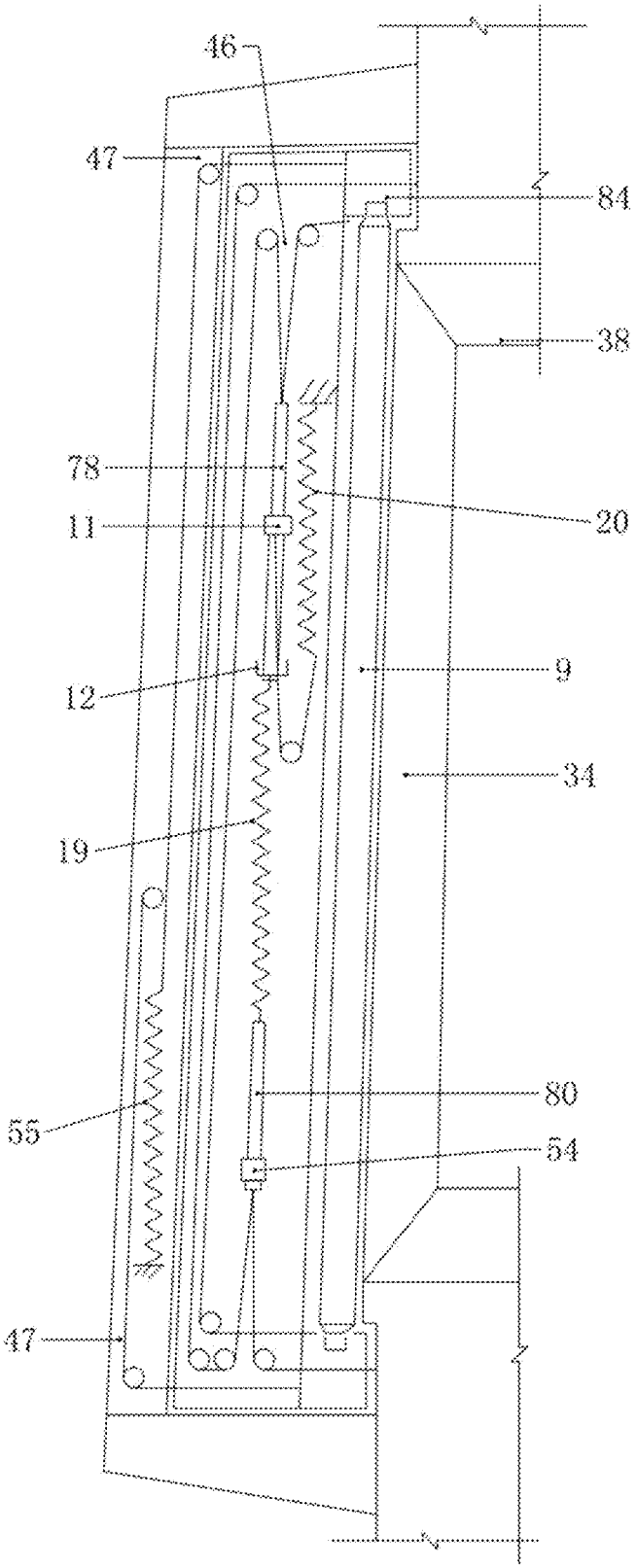
FIG. 21 is a schematic diagram of a switching mechanism of a cold storage door according to the present disclosure.
Figure 22:
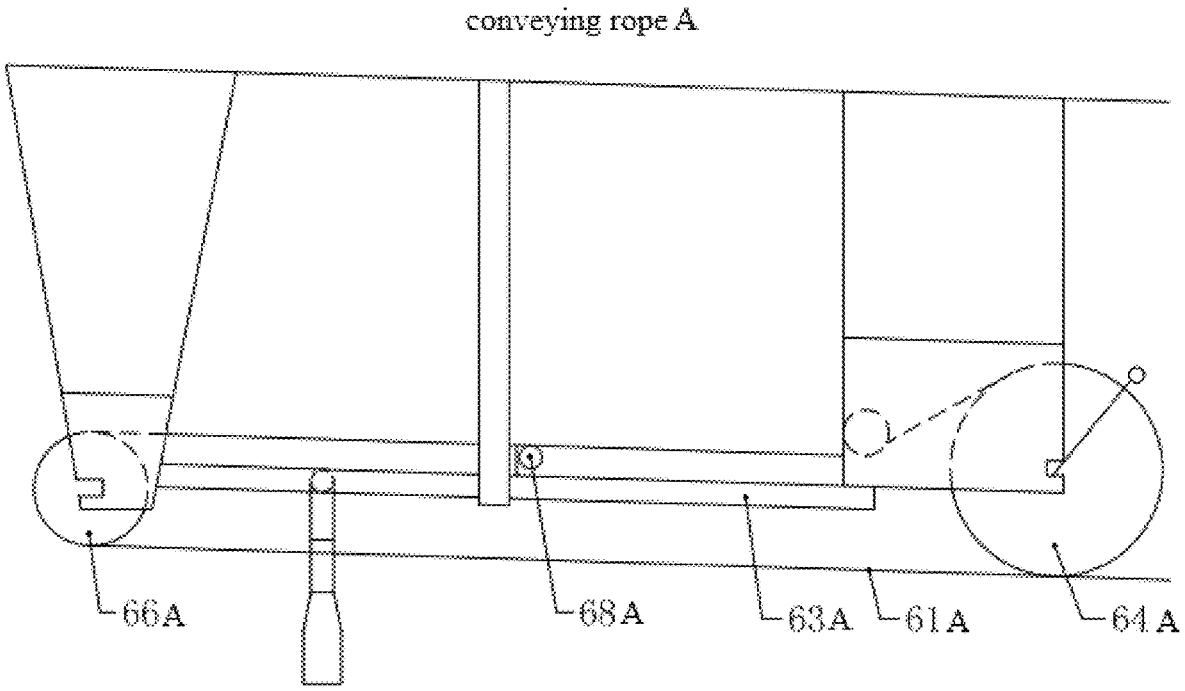
FIG. 22 is a schematic diagram of a conveying rope A according to the present disclosure.
Figure 23:
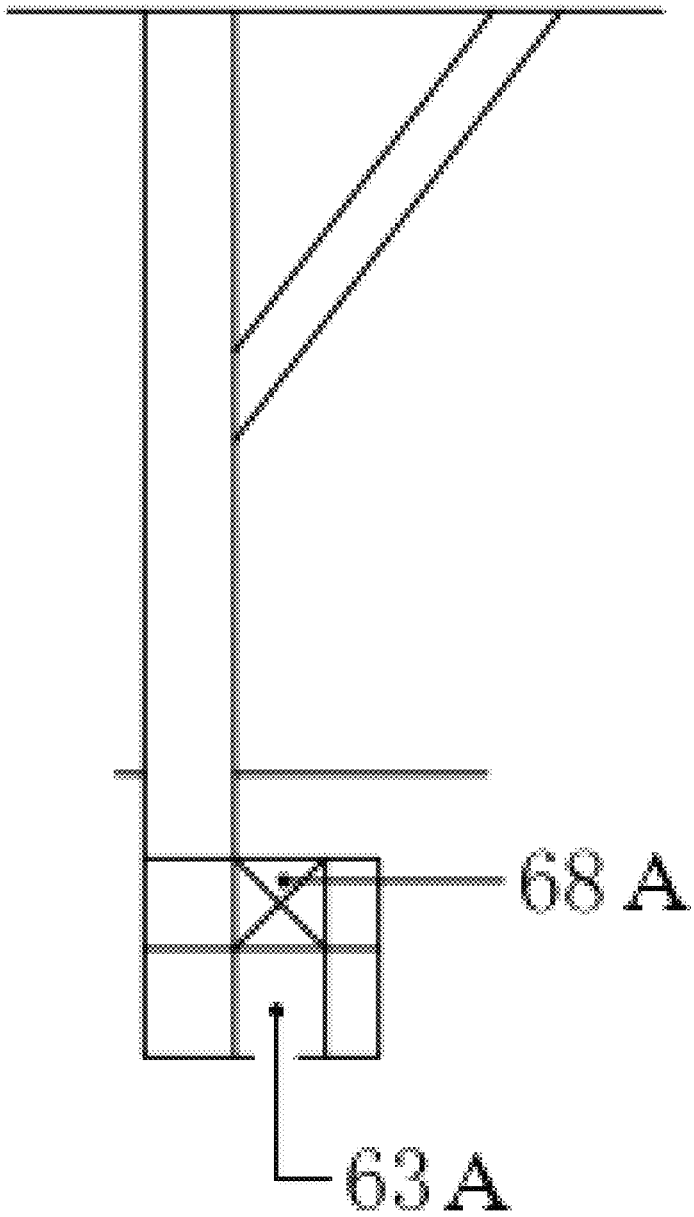
FIG. 23 is a cross-sectional diagram of a conveying rope A according to the present disclosure.
Figure 24:
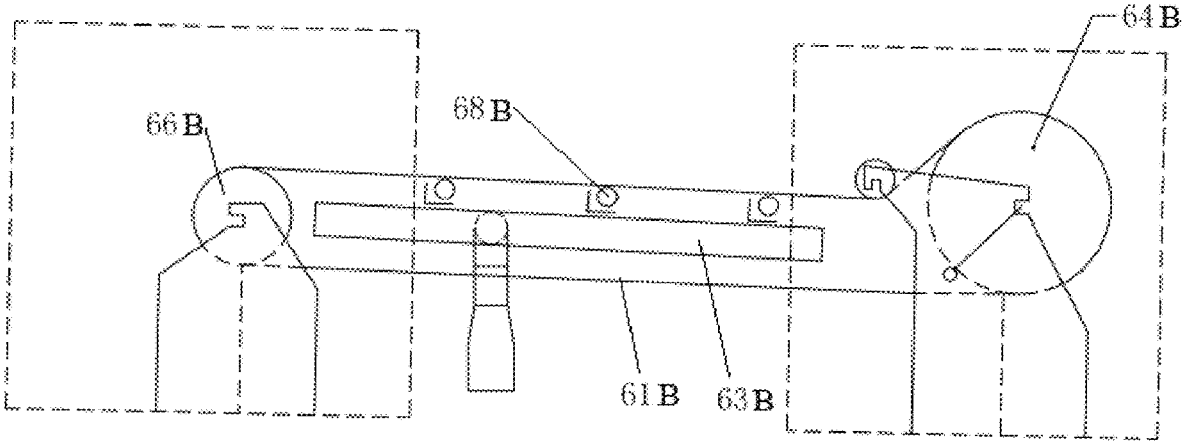
FIG. 24 is a schematic diagram of a conveying rope B according to the present disclosure.
Figure 25:
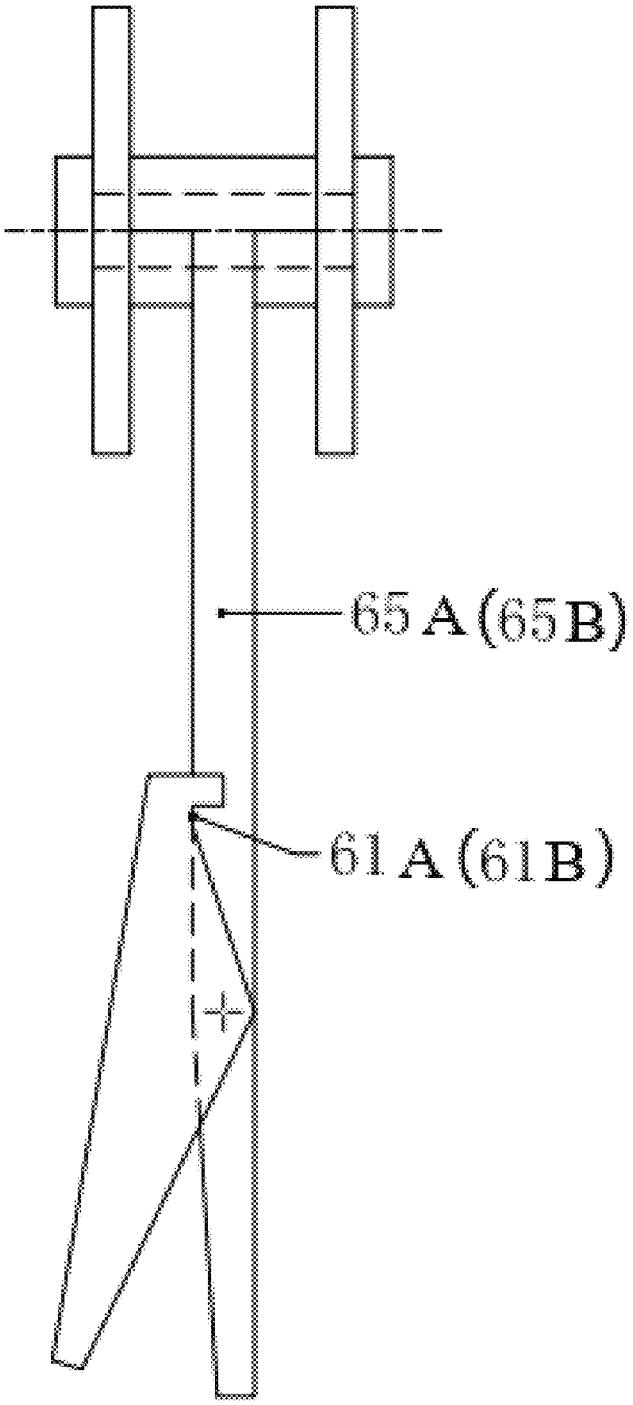
FIG. 25 is a schematic diagram of a block of a conveying rope A and a conveying rope B according to the present disclosure.
Figure 26:
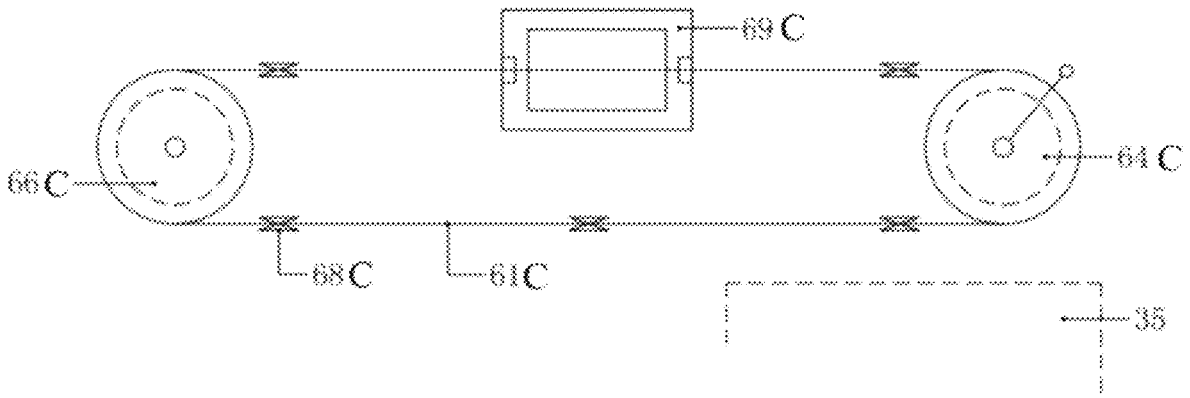
FIG. 26 is a schematic diagram of a conveying rope C according to the present disclosure.
Figure 27:
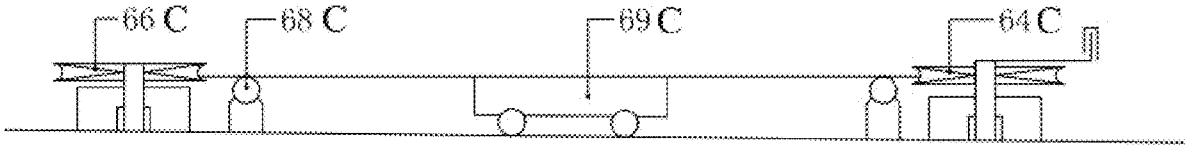
FIG. 27 is a front view of a conveying rope C according to the present disclosure.
Figure 28:
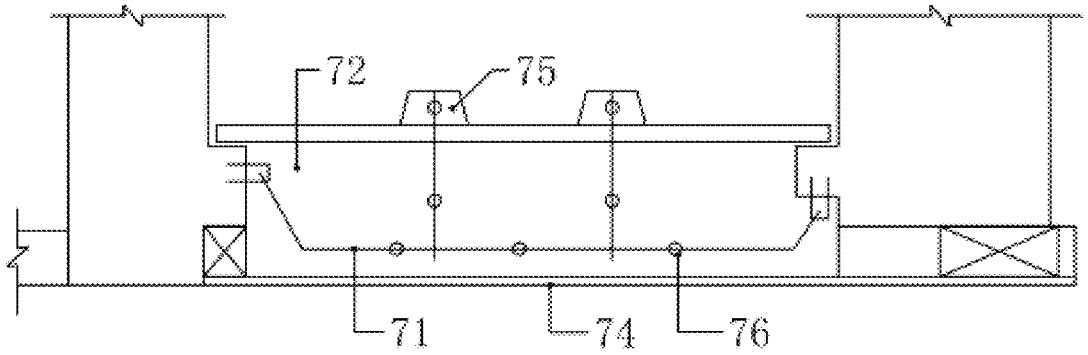
FIG. 28 is a schematic diagram of a top of an annular fireproof belt according to the present disclosure.
Figure 29:
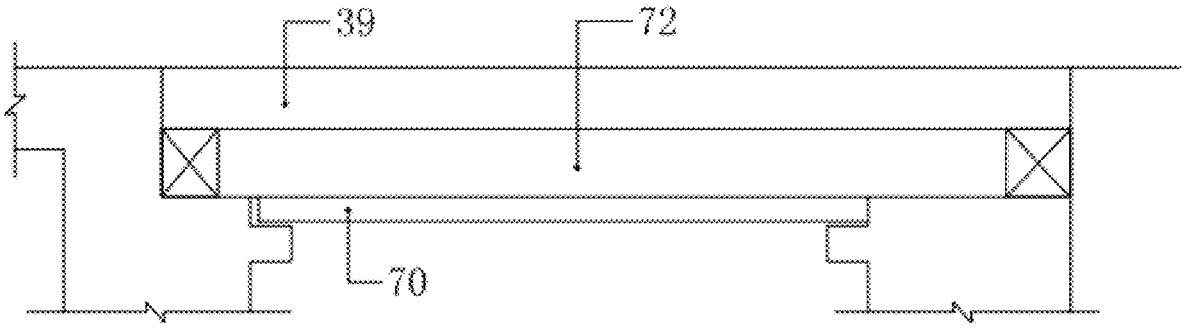
FIG. 29 is a schematic diagram of a lower part of an annular fireproof belt according to the present disclosure.
Figure 30:
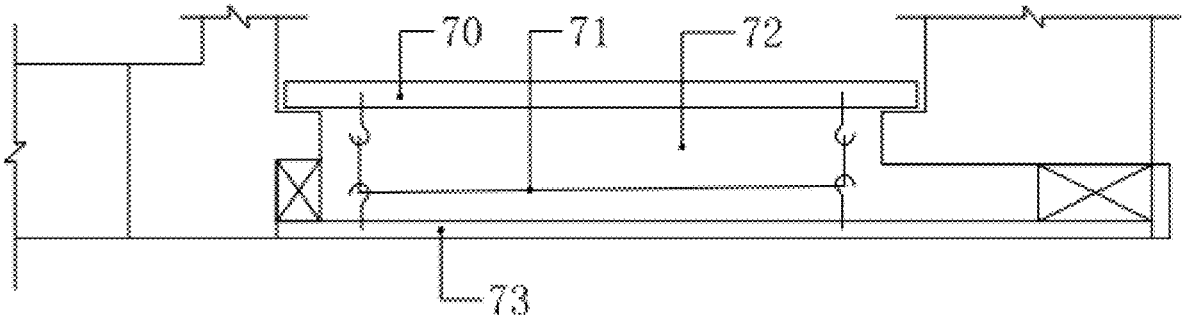
FIG. 30 is a schematic diagram of two sides of an annular fireproof belt according to the present disclosure.
Figure 31:
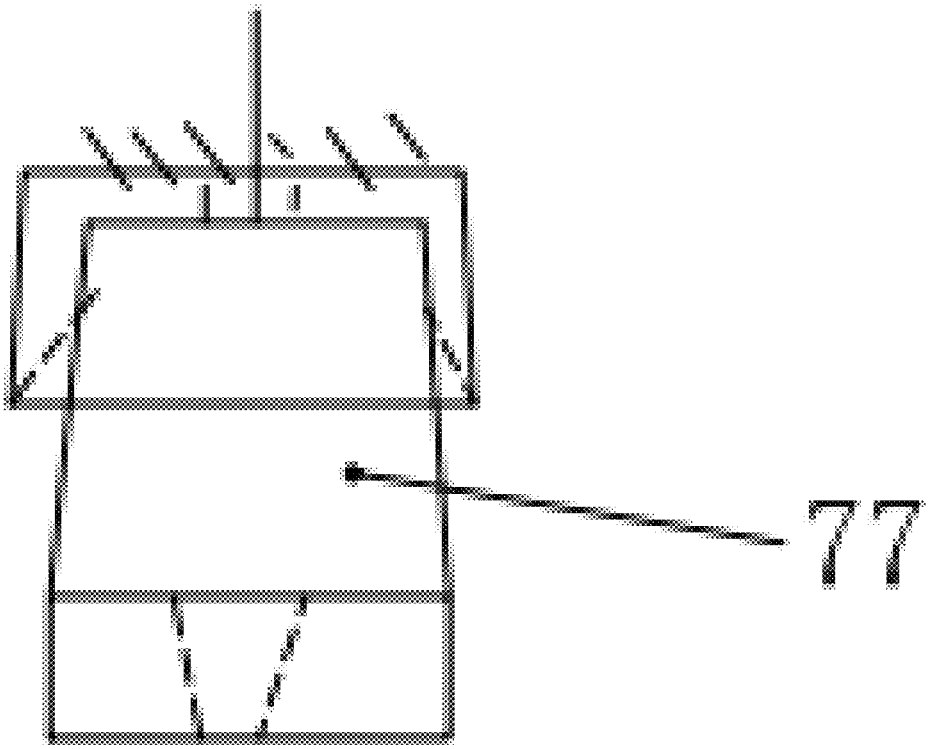
FIG. 31 is a front view of a pull ring according to the present disclosure.
Figure 32:
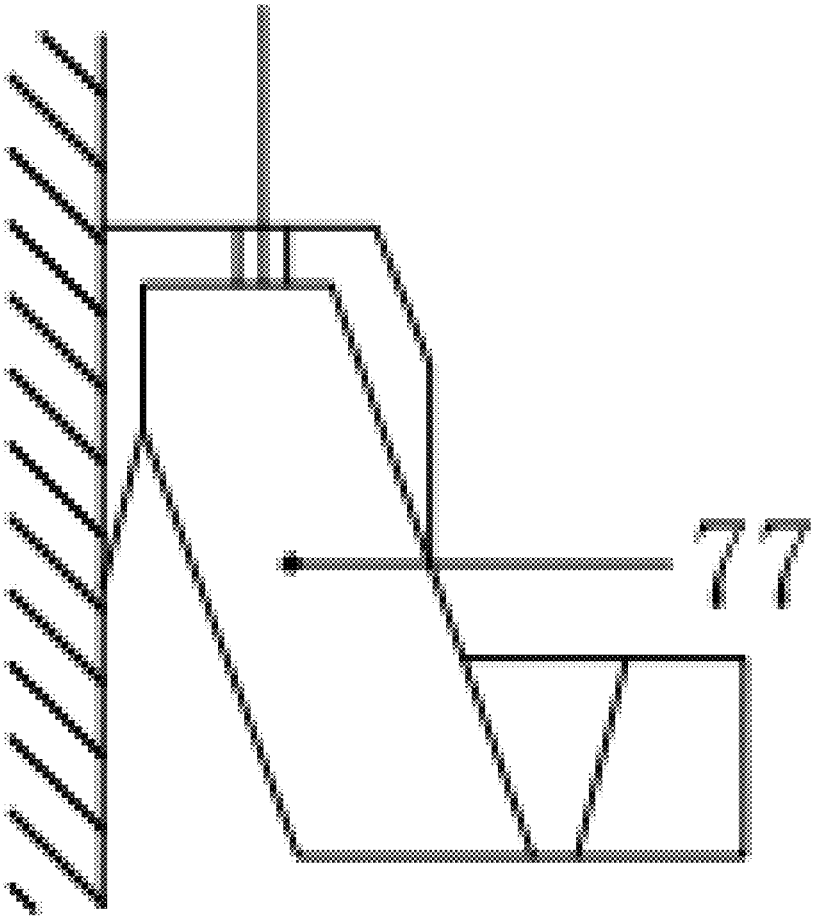
FIG. 32 is a side view of a pull ring according to the present disclosure.
Figure 33:
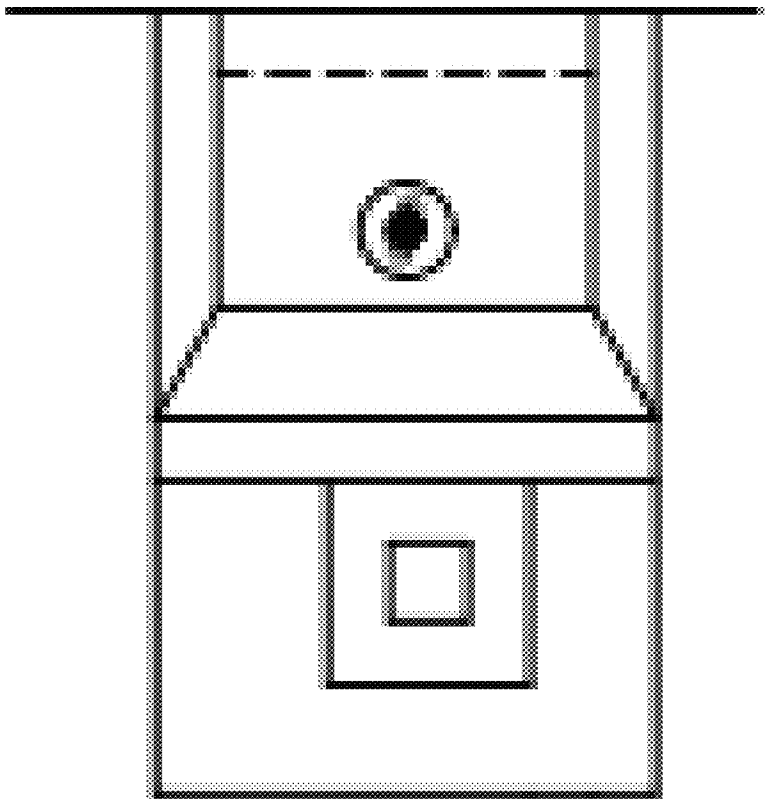
FIG. 33 is a top view of a pull ring according to the present disclosure.
Figure 34:
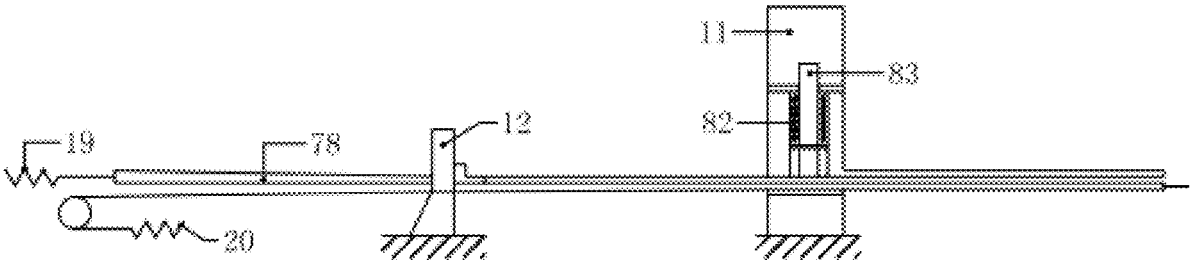
FIG. 34 is a schematic diagram of a pin B and a baffle according to the present disclosure.
Figure 35:
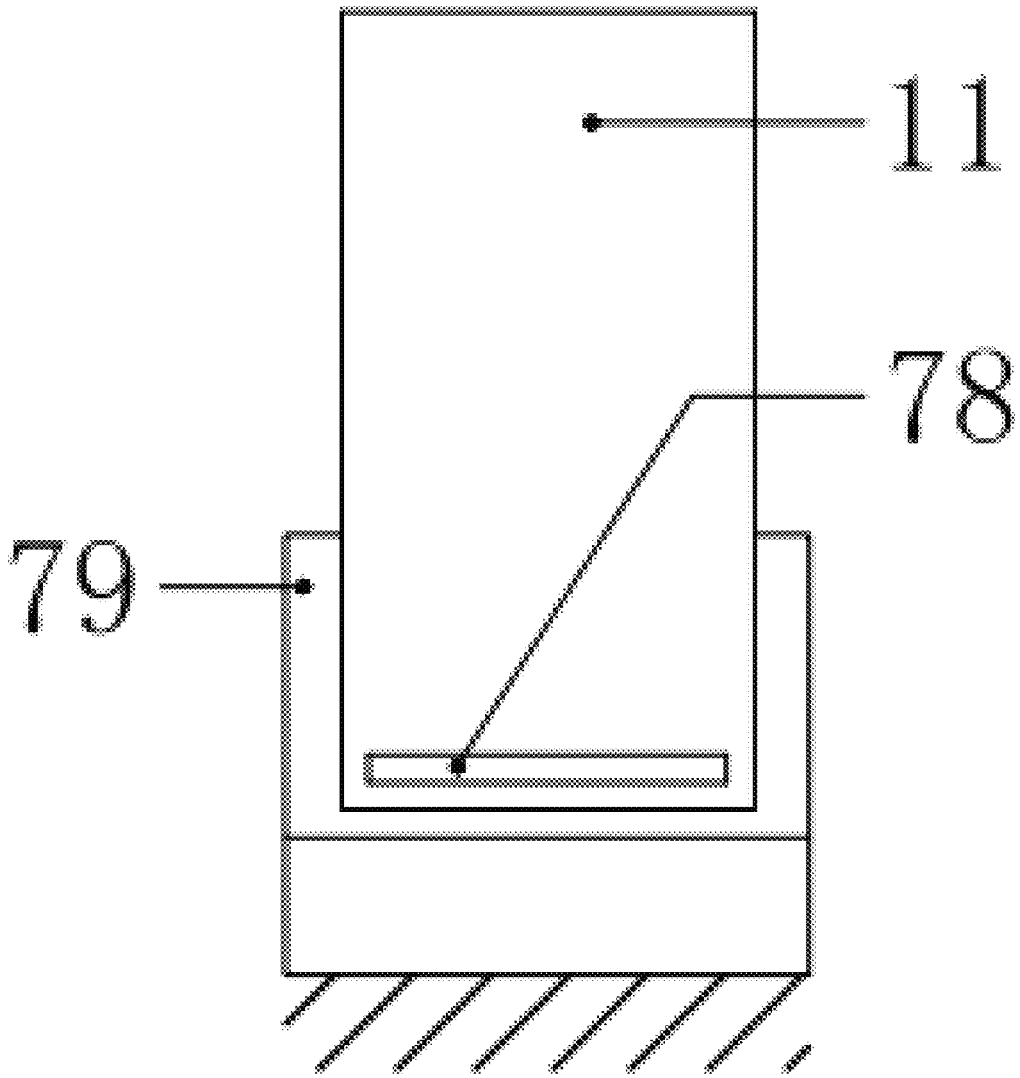
FIG. 35 is a schematic diagram of a pin B and a slideway according to the present disclosure.
Figure 36:
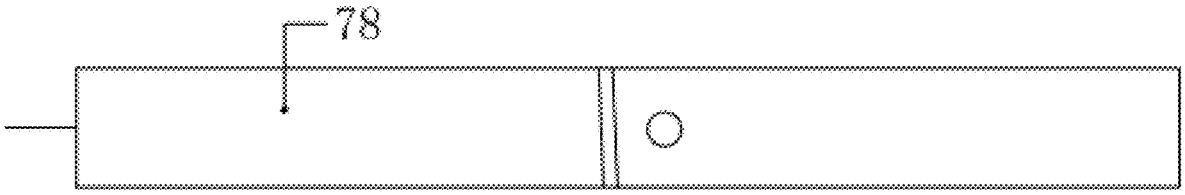
FIG. 36 is a schematic diagram of a sliding plate B according to the present disclosure.
Figure 37:
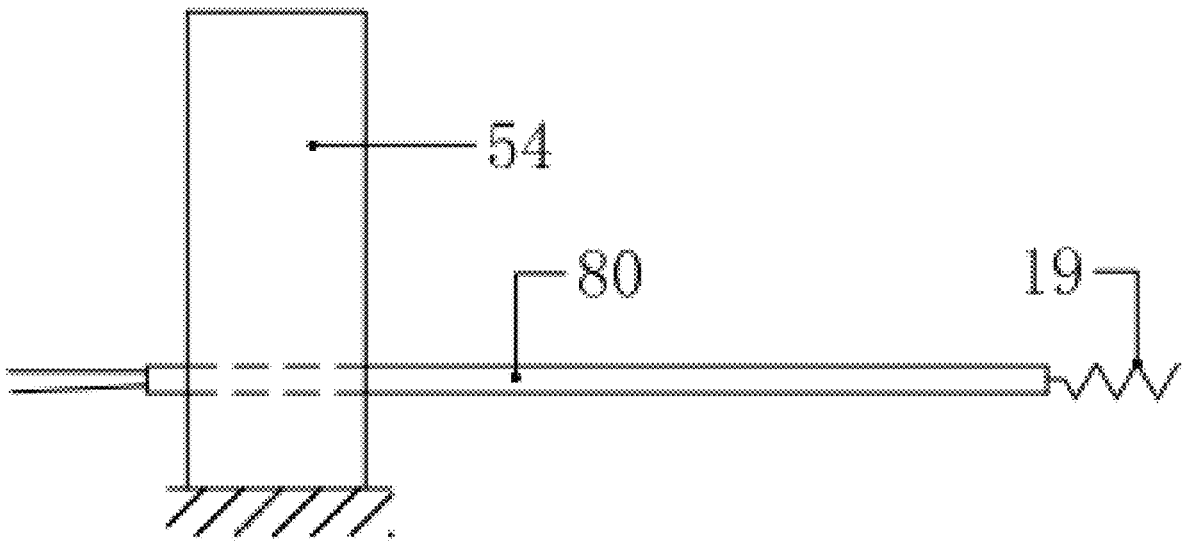
FIG. 37 is a schematic diagram of a pin A and a sliding plate A according to the present disclosure.
Figure 38:
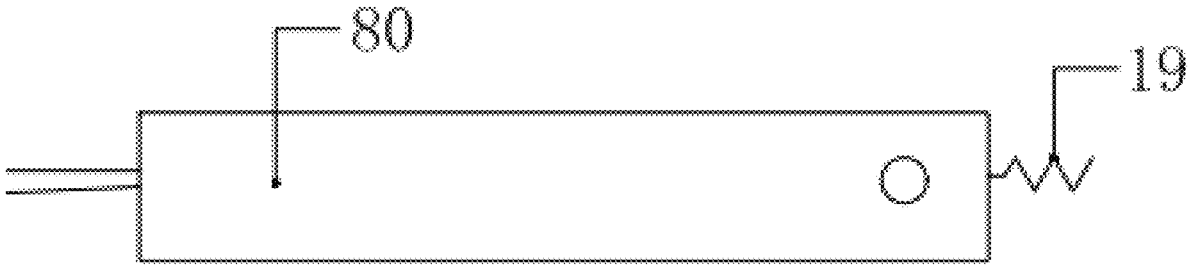
FIG. 38 is a schematic diagram of a sliding plate A according to the present disclosure.
Figure 39:
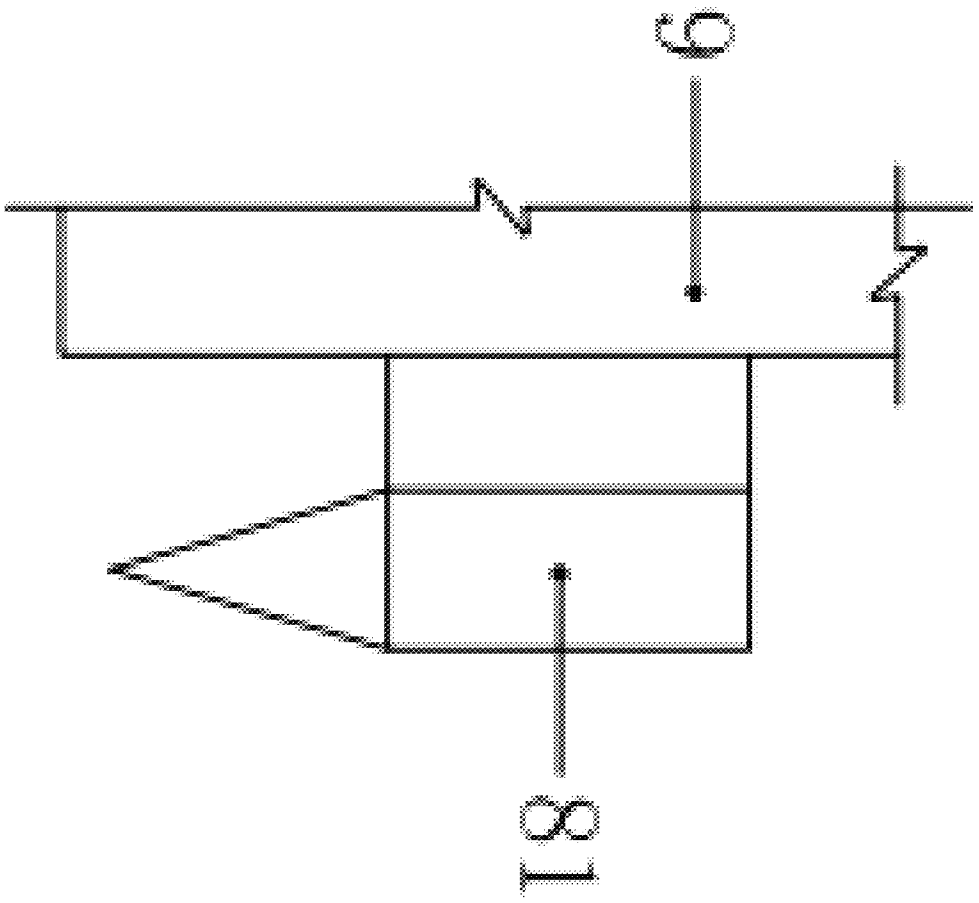
FIG. 39 is a side view of a pull hook according to the present disclosure.
Figure 40:
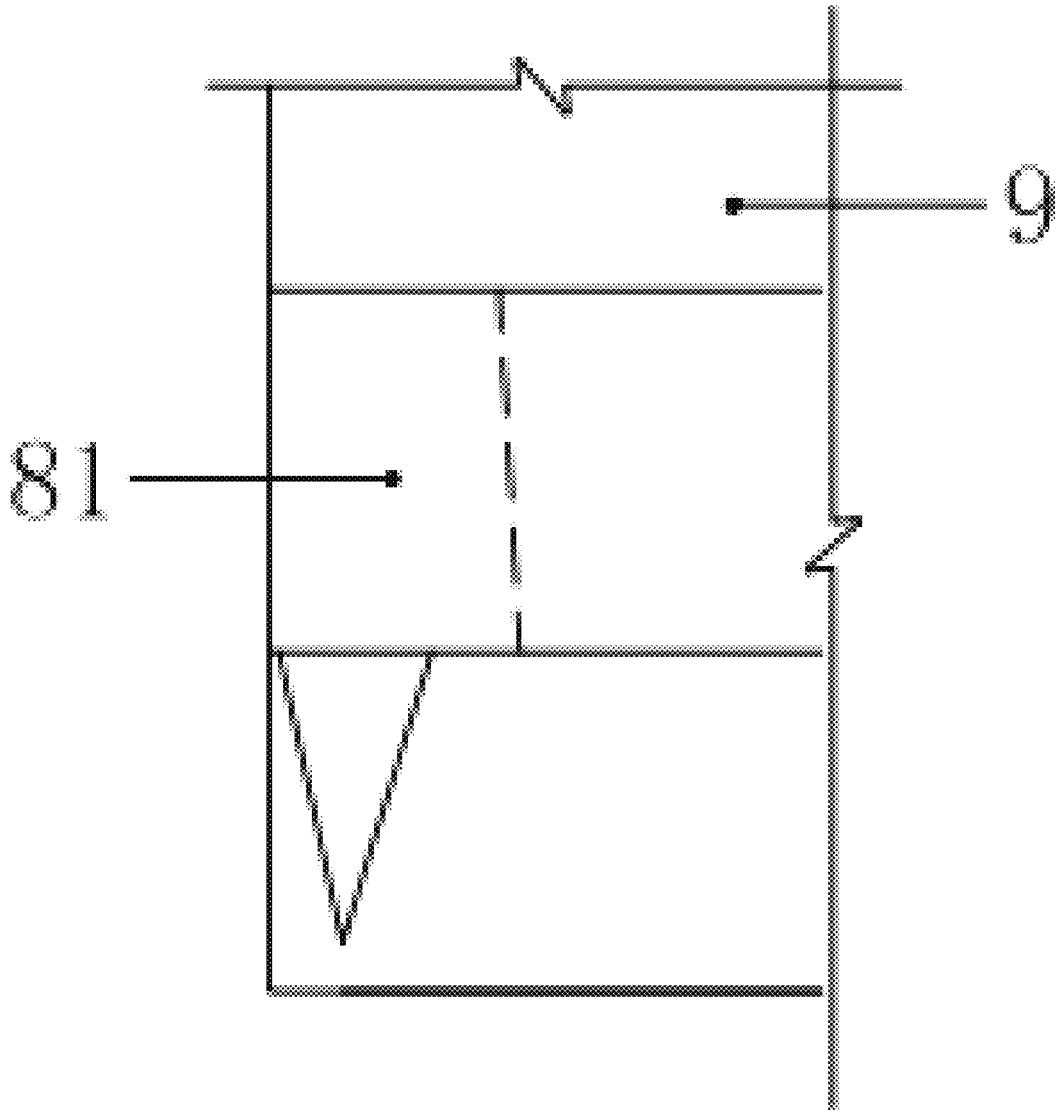
FIG. 40 is a front view of a pull hook according to the present disclosure.

The cold storage door 9 is of a lifting type. A door leaf of the cold storage door is spliced by a plurality of plastic door plates. A splicing seam is in a circular arc shape and is connected into a whole by a connection ring 44, and adjacent door plates is rotatable in one direction. The two sides of the door leaf are provided with a single-sided wheel 10 and a groove rail. A lower section of the groove rail is linear. A cross beam 46 connects the groove rails on both sides into a whole. The groove rails on both sides are rotatable synchronously around an axis of a root. An upper section of the groove rail is curved, and a top end is a horizontal straight line. The upper section of the groove rail is fixed with the cold store. The two sections of the groove rail are butted in the middle to form a complete door leaf operating track. The single-sided wheel 10 operates in the groove rail. The operating speed of the door leaf is controlled by a frequency converter. The cross beam 46 is provided with a spring A 19 and a spring C 20. A bracket 47 is provided with a spring B 55. A left end of the spring A 19 is provided with a pin A 54, and a right end of the spring A is provided with a pin B 11. A reset position of the pin B 11 is provided with a baffle 12. The groove rail is provided with a pull ring. The door leaf is provided with a pull hook. The pull hook is matched with the pull ring. FIG. 21 is a schematic diagram of a switching mechanism of a cold storage door. At this time, the cold storage door is in a closed state. The pin B 11 is energized and pulled out. The spring A 19 relaxes. The spring B 55 contracts to open the door. The door leaf is tilted outward in place to reset the pin A 54. As the cold storage door is lifted, the spring C contracts. The pull pin B 11 moves left to the baffle 12 to reset the pin B 11. When the door is closed, the door leaf falls. The pull hook and the pull ring are interlocked. The spring A 19 and the spring C 20 are stretched to store energy. The door touches the ground. The pin A 54 is pulled out, and the spring A 19 contracts to close the door.

The ball joint tie beam 15 is a reinforced concrete member with steel ball joint supports at both ends. Main reinforcements 56 are interlocked in two loops at the mid-span of the beam without contact with each other, and bear the entire tensile force of the beam, and other longitudinal reinforcements are all dislocated, disconnected and overlapped. The main reinforcements and other longitudinal reinforcements are welded with a head 57 at a beam end. The cross section of the mid-span of the beam is moderately increased.

A drying box consists of a box body, an air duct 58, a rotating head 59, an exhaust pipe 60, and a fin 43, and is connected to the exhaust pipe. The bottom of the box body is provided with an air inlet, and the front side and back side of the box body are provided with doors. The box body, the door crack, the air duct and the connecting part, and the place where the exhaust pipe 60 enters and exits the box body are all hermetically sealed. A length of the air duct is ≥12 m. A phenolic resin is used for foaming. The rotating head 59 is made of hard plastic with high temperature resistance of 120° C., weather resistance and self-lubrication, and is provided with a guide plate 62 to allow the air outlet to be always leeward. Five small wheels and a central shaft form a rotating mechanism, and a friction surface of the central shaft is coated with silicone oil. The box body and the air duct take heat insulation measures, and are fixed by using steel cables 53. The exhaust pipe 60 is made into an S-shape in the box body with an oil discharge slope of 0.004. The exhaust pipe 60 and the fin 43 form a drying bed. The fin is made of killed steel. The corners of the upper and lower bed surfaces, both ends and edges are polished, and the top inside the box is provided with an anti-suction net.

A desiccant which is non-toxic, odorless, renewable, non-corrosive to steel and concrete, and highly moisture-retentive is selected, and is put in the appropriate position of the water vapor channel, the vestibule, the cold room and the platform. The desiccant is immediately put into a vapor barrier bag after dehydration. Air is exhausted, and the vapor barrier bag is sealed and is put on a cooling rack. The cooling rack is first placed in a dry, cool and ventilated place for normal-temperature cooling, and then placed at the wall root opposite the cold storage door for low-temperature cooling.

The vapor barrier bag is made of materials with low water vapor permeability, high thermal conductivity, heat resistance of 130° C. and weather resistance, and the opening is capable of being sealed. The replaced desiccant is placed into a heat preservation container immediately, and is placed into a lower layer of the drying box as soon as possible.

Temperature and humidity sensor transmitters are provided at appropriate positions in the water vapor channel, the platform, and the vestibule, and inside and outside the cold store. A temperature and humidity sensor has the functions of automatic detection, transmission, recording, storage and early warning, and also has the functions of display and printing. When a line passes through the vapor barrier layer 5, sealing measures are taken. Two ends of the ball joint wood beam are provided with steel spherical supports which are matched with spherical beam ends. A chemical fiber braided strap and a steel bracket are used. Diameters of the steel spherical supports and the spherical beam ends are slightly larger than a cross-sectional diameter of the wood beam.

In a better embodiment, the heat insulation layer uses waste rice husk and foamed plastic.

In a better embodiment, the mortar for the wear-resistant waterproof ground 33 is formed by mixing cement, quartz sand, silica fume, a water reducer, a defoaming agent, and water. A water consumption is strictly controlled. Scrap iron finishes scattering in an initial setting stage, and a non-toxic and odorless cement seal curing agent is sprayed before the final light collection.

In a better embodiment, the annular fireproof belt 41 uses a wood substrate and a fire-resistant heat insulation layer. The fire-resistant heat insulation layer is formed by mixing water glass, expanded perlite and fire-resistant fibers. The thermal conductivity of the fire-resistant heat insulation layer material is $\lambda \leq 0.09$ w/m·k. The external wall fireproof layer is formed by mixing gypsum, expanded perlite, fire-resistant fibers and water.

In a better embodiment, an external heat insulation layer 34 of the cold storage door uses Cross-linked Polyethylene (XPE) foam. An external heat insulation layer 38 of the wall surface and the ceiling uses an Ethylene-Vinyl Acetate (EVA) foam prefabricated block with a skin. The external heat insulation layer uses a non-toxic and odorless dye to dye black-and-yellow alternating anti-color-blocking strips without changing flexibility and elasticity of the material.

In a better embodiment, the color steel plate seam uses a sealant with membrane elasticity, firm adhesion to the color steel plate, low water vapor permeability and weather resistance, and is fully scraped flat. After the sealant is dried, the coating with membrane ductility, weather resistance, low water vapor permeability and firm adhesion to the color steel plate and the sealant is applied straddling the seam as a coating vapor barrier layer. The seam extends 30 mm wider on both sides, respectively. A self-tapping screw cap is coated with a fireproof coating 48, and a nail hole seam is sealed.

In a better embodiment, the bamboo mat uses a beam plate structure. The plate is spliced by bamboo pieces with a gap of 2 mm sandwiched between beams. The beams are alternately glued by bamboo pieces and fiberized bamboo veneers and are reinforced with bamboo nails and galvanized iron wires. All the used bamboo materials are dewaxed.

In a better embodiment, the light steel structure wall surface is connected to the frame structure by a combination of a ball joint wood beam and a drawstring at the intersection point between the beam and the column.

Embodiments of the Present Disclosure

The present disclosure will be further described with reference to the attached drawings and specific embodiments.

Referring to FIG. 1 to FIG. 40, a green energy-saving cold store includes a cold room, a platform, a machine room, a refrigeration system. A drying layer 1 is arranged below a first floor of the cold room. A ground heat insulation layer 2 is moved downwards into the drying layer 1 and is separated from a first floor slab 3. An inner wall 4, an internal partition wall, and a wear-resistant waterproof ground 33 are all directly located on the first floor slab 3 and integrated with a frame structure. The wear-resistant waterproof ground 33 includes an inorganic wear-resistant system and an organic epoxy system. The drying layer 1 includes, from bottom to top, a concrete base 67, a leveling layer, a vapor barrier layer 5 wrapped to the top of a column, and a ground heat insulation layer 2 wrapped to the top of the column. A height that is of a water vapor channel A 6 and that is under a beam is ≥600 mm. A conveying rope A is arranged under the beam. The conveying rope A is provided with a traction rope 61, a sliding rail 63, a block 65, a pulley 66, a rocking wheel 64, and a supporting wheel 68. A first floor slab at a sending end of the conveying rope A is provided with an access hole A 13 which is hermetically sealed by a cover. The block is hung properly, and the desiccant is placed into the sliding rail 63 and is fixed with the traction rope. The rocking wheel 64 is rotated to send out the block . . . . The rocking wheel is reversed, so that the block returns, the block is removed, and the desiccant is replaced . . . . The access hole is provided based on the principle of facilitating desiccant replacement and maintenance, maximizing shared use as much as possible, and taking waterproofing into account.

A peripheral protective wall uses a light steel structure wall surface 14, which is connected to the frame structure by a ball joint tie beam 15 at an intersection point between a frame beam and a column, or is connected to the frame structure by a combination of a ball joint wood beam 45 and a drawstring 22 at the intersection point between the frame beam and the column. No ball joint tie beam 15 is arranged at the corner. A lower part of the light steel structure wall surface 14 is an anti-collision brick wall 16, and a top surface of the anti-collision brick wall is 1800 mm higher than an outdoor ground.

An inner side of the color steel plate wall surface is sequentially provided with a fireproof layer 17, a heat insulation layer 18, a water vapor channel B 7, an inner wall 4, a leveling layer, and a vapor barrier layer 5. A low-temperature side of the heat insulation layer 18 is provided with a water vapor channel B 7 around the inner wall 4. The water vapor channel B 7 is separated from the heat insulation layer 18 by a coarse steel mesh and a fine yarn mesh. A conveying rope B is arranged in the water vapor channel B 7. The conveying rope B is provided with a traction rope 61, a sliding rail 63, a block 65, a pulley 66, a rocking wheel 64, and a supporting wheel 68. The operation method is the same as that of the conveying rope A. The water vapor channel B 7 avoids a through-wall pipeline and the ball joint tie beam 15. A color steel plate seam and a nail hole seam are hermetically sealed, and a nailable fire-resistant heat insulation cushion block 24 is arranged between the color steel plate wall surface and a wall purlin 23. The fireproof layer 17 is leveled with cement mortar at a bottom sealing steel plate 26 and an elevation of a top surface of a top sealing beam 25. After the mortar is dried, a coating with membrane ductility, low water vapor permeability, firm adhesion to the color steel plate and weather resistance is used as a coating vapor barrier layer 28, which is hermetically sealed with the color steel plate wall surface, the bottom sealing steel plate 26, and the top surface of the top sealing beam 25. The fireproof layer 17 extends 50 mm wider on both sides, respectively. A welding seam between the bottom sealing steel plate 26, the top sealing beam 25 and the steel column 36 is hermetically sealed, and is polished smooth without sharp corners or burrs. The vapor barrier layer 5 of the anti-collision brick wall 16 is hermetically sealed with the bottom sealing steel plate 26. When selecting the anticorrosion coating for the top sealing beam 25, the adhesion to the PE membrane and the coating vapor barrier layer 28 should be taken into account.

An attic includes, from bottom to top, a vapor barrier layer 5, a leveling layer, an attic floor slab, a water vapor channel C 8 in which a concrete cushion block 30 elevates a bamboo mat by a height of 200 mm, a bamboo mat layer 31, a heat insulation layer 18, and a top sealing membrane 29. The periphery of the top sealing membrane 29 is hermetically sealed with the top sealing beam, and a sealing joint is reinforced with a pressing strip. The water vapor channel C 8 of the attic is provided with a conveying rope C. The conveying rope C is provided with a traction rope 61, a pulley 66, a rocking wheel 64, a supporting wheel 68, and a trolley 69. The use method of the conveying rope C is as follows: the trolley 69 is filled with a desiccant and is fixed with the traction rope 61. The rocking wheel 64 is rotated to send out the trolley 69 . . . . The rocking wheel 64 is reversed, so that the trolley 69 returns, and the desiccant is replaced . . . . The attic floor slab at both ends of the conveying rope C is provided with an access hole C 35 which is hermetically sealed by a cover. A bamboo mat layer on an upper part of the access hole C 35 is further raised by 350 mm, and a surrounding area is enclosed with the bamboo mat.

A color steel plate roof 32 includes a steel grid frame 27 with a geometrically invariant system, or a steel truss and a supporting system. The color steel plate roof 32 takes the steel column 36 of the light steel structure wall surface 14 as a support, and the steel structure is used as a fireproof protection layer.

A closed platform is used, and a vestibule is arranged in a cold storage room. A cold storage door 9 is arranged on the outer side. The heat insulation layer 34 is externally arranged on one side of the vestibule and matched with an external heat insulation layer 38 of a wall surface and a ceiling to form a complete heat insulation layer. The external heat insulation layer is made of materials which are non-toxic, odorless, non-moisture-retentive or extremely low in moisture absorption rate, low in thermal conductivity, elastic, impact-resistant, and weather-resistant. An airtight fireproof door 37 is arranged on an inner side of the vestibule. A transparent short door curtain 40 is arranged against the wall surface on one side of the vestibule. The short door curtain 40 is 1600 mm long. The top of the vestibule is provided with a top door 42, which has the functions of fire prevention and smoke prevention. A wooden bridge 39 spans an external wall heat insulation layer 18, and a polymer waterproof bridge floor is used. The external wall vapor barrier layer is integrally connected to the inner wall here to enclose the heat insulation layer. The heat insulation layer is used as an annular fireproof belt 41 here. The annular fireproof belt 41 uses a wooden plate wall surface 7 and a wooden plate ceiling 74. Brick wall powder of 180 is used for other parts of the vestibule.

The cold storage door 9 is of a lifting type. A door leaf of the cold storage door is spliced by a plurality of plastic door plates. A splicing seam is in a circular arc shape and is connected into a whole by a connection ring 44, and adjacent door plates is rotatable in one direction. The two sides of the door leaf are provided with a single-sided wheel 10 and a groove rail. A lower section of the groove rail is linear. A cross beam 46 connects the groove rails on both sides into a whole. The groove rails on both sides are rotatable synchronously around an axis of a root. An upper section of the groove rail is curved, and a top end is a horizontal straight line. The upper section of the groove rail is fixed with the cold store. The two sections of the groove rail are butted in the middle to form a complete door leaf operating track. The single-sided wheel 10 operates in the groove rail. The operating speed of the door leaf is controlled by a frequency converter. The cross beam 46 is provided with a spring A 19 and a spring C 20. A bracket 47 is provided with a spring B 55. A left end of the spring A 19 is provided with a pin A 54, and a right end of the spring A is provided with a pin B 11. A reset position of the pin B 11 is provided with a baffle 12. The groove rail is provided with a pull ring. The door leaf is provided with a pull hook. The pull hook is matched with the pull ring. FIG. 21 is a schematic diagram of a switching mechanism of a cold storage door. At this time, the cold storage door is in a closed state. The pin B 11 is energized and pulled out. The spring A 19 relaxes. The spring B 55 contracts to open the door. The door leaf is tilted outward in place to reset the pin A 54. As the cold storage door is lifted, the spring C contracts. The pull pin B 11 moves left to the baffle 12 to reset the pin B 11. When the door is closed, the door leaf falls. The pull hook and the pull ring are interlocked. The spring A 19 and the spring C 20 are stretched to store energy. The door touches the ground. The pin A 54 is pulled out, and the spring A 19 contracts to close the door.

The ball joint tie beam 15 is a reinforced concrete member with steel ball joint supports at both ends. Main reinforcements 56 are interlocked in two loops at the mid-span of the beam without contact with each other, and bear the entire tensile force of the beam, and other longitudinal reinforcements are all dislocated, disconnected and overlapped. The main reinforcements and other longitudinal reinforcements are welded with a head 57 at a beam end. The cross section of the mid-span of the beam is moderately increased.

A drying box consists of a box body, an air duct 58, a rotating head 59, an exhaust pipe 60, and a fin 43, and is connected to the exhaust pipe. The bottom of the box body is provided with an air inlet, and the front side and back side of the box body are provided with doors. The box body, the door crack, the air duct and the connecting part, and the place where the exhaust pipe 60 enters and exits the box body are all hermetically sealed. A length of the air duct is ≥12 m. A phenolic resin is used for foaming. The rotating head 59 is made of hard plastic with high temperature resistance of 120° C., weather resistance and self-lubrication, and is provided with a guide plate 62 to allow the air outlet to be always leeward. Five small wheels and a central shaft form a rotating mechanism, and a friction surface of the central shaft is coated with silicone oil. The box body and the air duct take heat insulation measures, and are fixed by using steel cables 53. The exhaust pipe 60 is made into an S-shape in the box body with an oil discharge slope of 0.004. The exhaust pipe 60 and the fin 43 form a drying bed. The fin is made of killed steel. The corners of the upper and lower bed surfaces, both ends and edges are polished, and the top inside the box is provided with an anti-suction net.

A desiccant which is non-toxic, odorless, renewable, non-corrosive to steel and concrete, and highly moisture-retentive is selected, and is put in the appropriate position of the water vapor channel, the vestibule, the cold room and the platform. The desiccant is immediately put into a vapor barrier bag after dehydration. Air is exhausted, and the vapor barrier bag is sealed and is put on a cooling rack. The cooling rack is first placed in a dry, cool and ventilated place for normal-temperature cooling, and then placed at the wall root opposite the cold storage door for low-temperature cooling.

The vapor barrier bag is made of materials with low water vapor permeability, high thermal conductivity, heat resistance of 130° C. and weather resistance, and the opening is capable of being sealed. The replaced desiccant is placed into a heat preservation container immediately, and is placed into a lower layer of the drying box as soon as possible.

Temperature and humidity sensor transmitters are provided at appropriate positions in the water vapor channel, the platform, and the vestibule, and inside and outside the cold store. A temperature and humidity sensor has the functions of automatic detection, transmission, recording, storage and early warning, and also has the functions of display and printing. When a line passes through the vapor barrier layer 5, sealing measures are taken. Two ends of the ball joint wood beam are provided with steel spherical supports which are matched with spherical beam ends. A chemical fiber braided strap and a steel bracket are used. Diameters of the steel spherical supports and the spherical beam ends are slightly larger than a cross-sectional diameter of the wood beam.

In a better embodiment, the heat insulation layer uses waste rice husk and foamed plastic.

In a better embodiment, the mortar for the wear-resistant waterproof ground 33 is formed by mixing cement, quartz sand, silica fume, a water reducer, a defoaming agent, and water. A water consumption is strictly controlled. Scrap iron finishes scattering in an initial setting stage, and a non-toxic and odorless cement seal curing agent is sprayed before the final light collection.

In a better embodiment, the annular fireproof belt 41 uses a wood substrate and a fire-resistant heat insulation layer. The fire-resistant heat insulation layer is formed by mixing water glass, expanded perlite and fire-resistant fibers. The thermal conductivity of the fire-resistant heat insulation layer material is $\lambda \leq 0.09$ w/m·k. The external wall fireproof layer is formed by mixing gypsum, expanded perlite, fire-resistant fibers and water.

In a better embodiment, an external heat insulation layer 34 of the cold storage door uses Cross-linked Polyethylene (XPE) foam. An external heat insulation layer 38 of the wall surface and the ceiling uses an Ethylene-Vinyl Acetate (EVA) foam prefabricated block with a skin. The external heat insulation layer uses a non-toxic and odorless dye to dye black-and-yellow alternating anti-color-blocking strips without changing flexibility and elasticity of the material.

In a better embodiment, the color steel plate seam uses a sealant with membrane elasticity, firm adhesion to the color steel plate, low water vapor permeability and weather resistance, and is fully scraped flat. After the sealant is dried, the coating with membrane ductility, weather resistance, low water vapor permeability and firm adhesion to the color steel plate and the sealant is applied straddling the seam as a coating vapor barrier layer. The seam extends 30 mm wider on both sides, respectively. A self-tapping screw cap is coated with a fireproof coating 48, and a nail hole seam is sealed.

In a better embodiment, the bamboo mat uses a beam plate structure. The plate is spliced by bamboo pieces with a gap of 2 mm sandwiched between beams. The beams are alternately glued by bamboo pieces and fiberized bamboo veneers and are reinforced with bamboo nails and galvanized iron wires. All the used bamboo materials are dewaxed.

In a better embodiment, the light steel structure wall surface is connected to the frame structure by a combination of a ball joint wood beam and a drawstring at the intersection point between the beam and the column.

Industrial Practicability

After the structure of the present disclosure is used, the inner wall, the internal partition wall and the wear-resistant waterproof ground are all directly located on the first floor slab and integrated with a frame structure, thus solving the earthquake resistance, waterproofing, and wear resistance problems of the first floor in the cold room, and eliminating the need of the ground waterproof layer, the reinforced concrete bonding layer (ground), and the expensive ground heat insulation layer. The ground heat insulation layer is not under a heavy pressure. The heat insulation material is in the state of natural accumulation with maximum porosity and minimum thermal conductivity, which improves the heat insulation effect of the ground heat insulation layer without considering the compressive strength of the heat insulation material, and also creates technical conditions for thickening the ground heat insulation layer. Thickening the heat insulation layer is the most effective method to save energy, reduce the operating cost of the cold store, stabilize the temperature of the cold store and prevent the foundation from frost heaving, which saves the construction funds invested in preventing the foundation from frost heaving and a lot of energy consumed in the service life of the cold store.

When the volume moisture content of the organic heat insulation material is zero, the porosity decreases from 98% to 96%, and the thermal conductivity increases from 0.03489 w/m·k to 0.053498 w/m·k, which is 53.33% higher.

The ground heat insulation layer moves downwards, and the first floor slab and the beam become the cold storage body in the cold room, which can stabilize the temperature of the cold store.

The light steel structure wall surface has strong deformability, especially out-of-plane deformation, small mass, and small earthquake action. The ball joint tie beam or the ball joint wood beam may swing freely in all directions within the set range. The steel grid frame has small mass, small earthquake action, and strong deformability, and may not collapse even if individual members have plastic hinges. Combining the light steel structure wall surface, the ball joint tie beam, and the steel grid frame, the cold store building can coordinate the vibration during an earthquake (in fact, the light steel structure wall surface and the color steel plate roof obey the vibration of the frame structure), which improves the earthquake resistance of the cold store building.

In the heat insulation layer, the water vapor channel has low temperature and high humidity, which is the best place for a desiccant to function. A color steel plate is vapor-impermeable, and the joint between plates is very small. Assuming that the joint length is 4000 m (the corresponding wall surface is about 2660 m2), the joint width is 0.2 mm, and the water vapor penetration area is =4000×0.0002=0.8 m2. Additionally, the width of the sealant membrane is equal to the thickness of the vapor-permeable sealant membrane, which is 20 mm. There is also a barrier of the coating vapor barrier layer. Thus, the water vapor penetration intensity is extremely low for the entire wall surface. The top sealing membrane is made of a double-layer PE membrane, which reduces the penetration intensity by half. The water vapor permeability of rice husk is high. Dewaxing of bamboo materials used in the bamboo mat improves the water vapor permeability. At 20° C., the drying effect of a silica gel is 0.006 g/m3 of residual water vapor, and the moisture absorption of the silica gel is stronger at −20° C., which is beneficial to drying the heat insulation layer. In this way, the heat insulation layer can be kept in a very dry state, and the actual thermal conductivity of the heat insulation material is lower than the designed thermal conductivity. The thermal conductivity of water is 20 times higher than that of air, and the thermal conductivity of ice is 80 times higher than that of air, which improves the heat insulation effect of the heat insulation layer and reduces the operating cost of the cold store. The drying hood can dry hot wet air entering the cold store, slow down the frost rate of the exhaust pipe, and reduce the number of defrosting times.

Use of the color steel plate roof and the steel grid frame eliminates all cold bridges on the roof (the reinforced concrete column passes through the roof heat insulation layer), saves a lot of energy, and reduces the operating cost of the cold store.

A closed platform is used, which limits the exchange of cold and hot air, reduces energy loss, slows down the frosting rate of the exhaust pipe, and creates conditions for preventing the door crack from freezing.

The drying box uses the waste heat of the high-temperature working medium as the desiccant to dehydrate and cool the working medium, which no longer consumes energy, achieves triple-effect energy-saving, and reduces the operating cost of the cold store.

When the cold storage door is closed, the top door and the fireproof door may automatically open, and the cold air in the cold store may flow into the vestibule from the fireproof door, which is blocked by a short door curtain at the top. The hot air in the vestibule may rush out from the top door conveniently and enter the drying hood, bypassing an upward opening of the top door (the door crack). The hot air may stay in the vestibule for a very short time (in seconds), and the wall surface freezes a little, which may be absorbed by the desiccant. The vestibule may stay in a dry state. The fireproof door crack and the top door crack may not freeze. The cold storage door crack is in the normal temperature area.

The heat insulation layer uses waste rice husk and foamed plastic, which reduces environmental pollution, reduces the project cost, and has no raw material, energy, labor and environmental pollution due to the production of the heat insulation material.

No toxic gas is produced in the construction process of rice husk.

The purchase price of waste polystyrene foam plastic is 0.8 yuan/kg. Rice husk and other foam plastic are not purchased, which reduces the project cost, reduces environmental pollution, and creates economic conditions for thickening the heat insulation layer. The temperature and humidity sensor can control the temperature and humidity change of relevant parts and the water vapor permeability law in real time, and the desiccant is replaced as appropriate. Main reinforcements of the ball joint tie beam are interlocked in two loops without contact with each other, and other longitudinal reinforcements are all dislocated, disconnected and overlapped. There is no longitudinal through reinforcement in the entire beam, so that the effect of the cold bridge is greatly reduced. The thermal conductivity of ball joint wood beam is lower.

FREE CONTENT OF A SEQUENCE TABLE

The description paragraphs of free content of the sequence table are input here.

What is claimed is:

1. A green energy-saving cold store, comprising a cold room, a platform, a machine room, and a refrigeration system, wherein a drying layer (1) is arranged below a first floor of the cold room, a ground heat insulation layer (2) is moved downwards into the drying layer (1) and is separated from a first floor slab (3), and an inner wall (4), an internal partition wall, and a wear-resistant waterproof ground (33) are all directly located on the first floor slab (3) and integrated with a frame structure, wherein the wear-resistant waterproof ground (33) comprises an inorganic wear-resistant system and an organic epoxy system;

the drying layer (1) comprises, from bottom to top, a concrete base (67), a leveling layer, a vapor barrier layer (5) wrapped to the top of a column, and a ground heat insulation layer (2) wrapped to the top of the column, wherein a height that is of a water vapor channel A (6) and that is under a beam is ≥600 mm, a conveying rope A is arranged under the beam, the conveying rope A is provided with a first traction rope (61A), a first sliding rail (63A), a first pulley (66A), a first block (65A), a first rocking wheel (64A), and a first supporting wheel (68A), and a first floor slab at a sending end of the conveying rope A is provided with an access hole A (13) which is hermetically sealed by a cover;

a peripheral protective wall uses a light steel structure wall surface (14), which is connected to the frame structure by a ball joint tie beam (15) at an intersection point between a frame beam and a column, or is connected to the frame structure by a combination of a ball joint wood beam (45) and a drawstring (22) at the intersection point between the frame beam and the column;

a lower part of the light steel structure wall surface is an anti-collision brick wall (16), and a top surface of the anti-collision brick wall is 1800 mm higher than an outdoor ground; a connection point on a lower part of each steel column is a rigid connection point, and an inter-column support is arranged between steel columns;

an inner side of a color steel plate wall surface is sequentially provided with a fireproof layer (17), a heat insulation layer (18), a water vapor channel B (7), the inner wall (4), a leveling layer, and the vapor barrier layer (5);

a low-temperature side of the heat insulation layer (18) is provided with the water vapor channel B (7) around the inner wall (4), the water vapor channel B (7) is separated from the heat insulation layer (18) by a coarse steel mesh and a fine yarn mesh, a conveying rope B is arranged in the water vapor channel B (7), the conveying rope B is provided with a second traction rope (61B), a second sliding rail (63B), a second block (65B), a second pulley (66B), a second rocking wheel (64B), and a second supporting wheel (68B), both sides of the conveying rope B is provided with an access hole B (21), and the access hole B (21) is additionally installed every 9 m to 12 m in the middle, which is hermetically sealed by a cover;

the water vapor channel B (7) avoids a through-wall pipeline and the ball joint tie beam (15);

a color steel plate seam and a nail hole seam are hermetically sealed, and a nailable fire-resistant heat insulation cushion block (24) is arranged between the color steel plate wall surface and a wall purlin (23);

the fireproof layer (17) is leveled with cement mortar at a bottom sealing steel plate (26) and an elevation of a top surface of a top sealing beam (25), after the mortar is dried, a coating with membrane ductility, low water vapor permeability, firm adhesion to a color steel plate and weather resistance is used as a coating vapor barrier layer (28), the fireproof layer (17) extends 50 mm wider on both sides, respectively, a welding seam between the bottom sealing steel plate (26), the top sealing beam (25) and the steel column (36) is hermetically sealed, and is polished smooth without corners or burrs;

an attic comprises, from bottom to top, the vapor barrier layer (5), a leveling layer, an attic floor slab, a water vapor channel C (8) in which a concrete cushion block (30) elevates a bamboo mat by a height of 200 mm, a bamboo mat layer (31), a heat insulation layer (18), and a top sealing membrane (29), the top sealing membrane is made of a double-layer PE membrane, the periphery of the top sealing membrane (29) is hermetically sealed with the top sealing beam (25), and a sealing joint is reinforced with a pressing strip;

the water vapor channel C (8) of the attic is provided with a conveying rope C, the conveying rope C is provided with a third traction rope (61C), a third pulley (66C), a third rocking wheel (64C), a third supporting wheel (68C), and a third trolley (69C), the attic floor slab at both ends of the conveying rope is provided with an access hole C (35) which is hermetically sealed by a cover, a bamboo mat layer on an upper part of the access hole C (35) is further raised by 350 mm, and a surrounding area is enclosed with the bamboo mat;

a color steel plate roof (32) uses a steel grid frame (27) with a geometrically invariant system, and the color steel plate roof (32) takes the steel column (36) of the light steel structure wall surface (14) as a support, and the steel structure is used as a fireproof protection layer; a closed platform is used, and a vestibule is arranged in a cold storage room;

a cold storage door (9) is arranged on the outer side, a first external heat insulation layer (34) is externally arranged on one side of the vestibule and matched with a second external heat insulation layer (38) of a wall surface and a ceiling to form a complete heat insulation layer;

the first external heat insulation layer (34) and the second external heat insulation layer (38) are made of materials which are non-toxic, odorless, non-moisture-retentive or extremely low in moisture absorption rate, low in thermal conductivity, elastic, impact-resistant, and weather-resistant;

the first external heat insulation layer (34) and the second external heat insulation layer (38) are coated with non-toxic and odorless silicone oil at a door crack;

an airtight fireproof door (37) is arranged on an inner side of the vestibule, a transparent short door curtain (40) is arranged against the wall surface on one side of the vestibule, the short door curtain (40) is 1600 mm long, the top of the vestibule is provided with a top door (42), which has the functions of fire prevention and smoke prevention;

a drying hood with a downward opening is arranged under the ceiling on an upper part of the top door, the opening of the hood is aimed at the top door and larger than the top door, a size of the hood is able to accommodate hot and humid air discharged into the cold store by the vestibule, and a desiccant is put into the hood;

a wooden bridge (39) spans an heat insulation layer (18), and a polymer waterproof bridge floor is used;

the external wall vapor barrier layer is integrally connected to the inner wall here to enclose the heat insulation layer, the heat insulation layer is used as an annular fireproof belt (41) here, the annular fireproof belt (41) uses a wooden plate wall surface (73) and a wooden plate ceiling (74), and brick wall powder is used for other parts of the vestibule;

the cold storage door (9) is of a lifting type, a door leaf of the cold storage door is spliced by a plurality of plastic door plates, a splicing seam is in a circular arc shape and is connected into a whole by a connection ring (44), and adjacent door plates is rotatable in one direction;

a lifting rope of the cold storage door is connected to a lower part of the door leaf, the two sides of the door leaf are provided with a single-sided wheel (10) and a groove rail (84), a lower section of the groove rail is linear, a cross beam (46) connects the groove rails on both sides into a whole, and the groove rails on both sides are rotatable synchronously around an axis of a root;

an upper section of the groove rail is curved, and a top end is a horizontal straight line, the upper section of the groove rail is fixed with the cold store, the two sections of the groove rail (84) are butted in the middle to form a complete door leaf operating track, the single-sided wheel (10) operates in the groove rail, the operating speed of the door leaf is controlled by a frequency converter, the cross beam (46) is provided with a spring A (19) and a spring C (20), a bracket (47) is provided with a spring B (55), a left end of the spring A (19) is provided with a pin A (54), and a right end of the spring A is provided with a pin B (11), a reset position of the pin B (11) is provided with a baffle (12), the door leaf is provided with a pull hook, the groove rail is provided with a pull ring, the pull hook is matched with the pull ring;

the pin A (54) and the pin B (11) have the same internal structures, in which an electromagnet and a spring D (82) are used to control the withdrawal and reset of a pin (83), the pin (83) controls the action of a sliding plate, the pin A (54) and the pin B (11) are made of self-lubricating hard plastic, the pin B (11) is fixed, the pin A (11) runs on a slideway (79), a sliding plate A (80) slides in the pin A (54), and a sliding plate B (78) slides in the pin B (11);

both sides of the door leaf are respectively provided with the pull hook (81) symmetrically, the groove rails are respectively provided with the pull ring (77) on both sides of the door leaf symmetrically, the pull hook (81) is arranged on a lower part of the door leaf, the pull ring (77) is arranged on the upper part of the pull hook (81), the pull hook is matched with the pull ring, and the pull ring (77) is connected to the pin B (11) by a rope;

the ball joint tie beam (15) is a reinforced concrete member with steel ball joint supports at both ends, main reinforcements (56) are interlocked in two loops at the mid-span of the beam without contact with each other, and bear the entire tensile force of the beam, and other longitudinal reinforcements are all dislocated, disconnected and overlapped; the main reinforcements (56) and other longitudinal reinforcements are welded with a head (57) at a beam end; the top of the ball joint support is provided with a hole, through which the main reinforcement passes;

there is a gap between the periphery of the main reinforcement and the wall of the hole, the hole is a swing space of the main reinforcement, the size of the hole determines a swing amplitude of the ball joint tie beam, and the cross section of the mid-span of the beam is increased;

two ends of the ball joint wood beam (45) are provided with steel spherical supports (49) which are matched with spherical beam ends, and diameters of the spherical supports (49) and the spherical beam ends are slightly larger than a cross-sectional diameter of the wood beam (45); and the drawstring (22) uses a chemical fiber braided strap with good performance and a steel bracket (50);

a drying box consists of a box body, an air duct (58), a rotating head (59), an exhaust pipe (60), and a fin (43), and is connected to the exhaust pipe; the bottom of the box body is provided with an air inlet, and the front side and back side of the box body are provided with doors; the box body, the door crack, the air duct and the connecting part, and the place where the exhaust pipe enters and exits the box body are all hermetically sealed; a length of the air duct (58) is ≥12 m, heat insulation measures are taken, the rotating head (59) is made of hard plastic with high temperature resistance of 120° C., weather resistance and self-lubrication, and is provided with a guide plate (62) to allow the air outlet to be always leeward;

five small wheels (51) and a central shaft (52) form a rotating mechanism, and a friction surface of the central shaft is coated with silicone oil; the box body and the air duct (58) take heat insulation measures, and are fixed by using steel cables (53); the exhaust pipe (60) is made into an S-shape in the box body with an oil discharge slope of 0.004, the exhaust pipe (60) and the fin (43) form a drying bed, the fin (43) is made of killed steel, the corners of the upper and lower bed surfaces, both ends and edges are polished, and the top inside the box is provided with an anti-suction net;

a desiccant which is non-toxic, odorless, renewable, non-corrosive to steel and concrete, and highly moisture-retentive is selected, and is put in the appropriate position of the water vapor channel, the vestibule, the cold room and the platform; the desiccant is immediately put into a vapor barrier bag after dehydration, air is exhausted, the vapor barrier bag is sealed and is put on a cooling rack, the cooling rack is first placed in a dry, cool and ventilated place for normal-temperature cooling, and then placed at the wall root opposite the cold storage door for low-temperature cooling; the vapor barrier bag is made of materials with low water vapor permeability, high thermal conductivity, heat resistance of 130° C. and weather resistance, and the opening is capable of being sealed; and the replaced desiccant is placed into a heat preservation container immediately, and is placed into a lower layer of the drying box as soon as possible;

temperature and humidity sensor transmitters are provided at appropriate positions in the water vapor channel, the drying hood, the platform, and the vestibule, and inside and outside the cold store; a temperature and humidity sensor has the functions of automatic detection, transmission, recording, storage and early warning, and also has the functions of display and printing, and when a line passes through the vapor barrier layer (5), sealing measures are taken.

2. The green energy-saving cold store according to claim 1, wherein the heat insulation layer uses waste rice husk and foamed plastic.

3. The green energy-saving cold store according to claim 1, wherein the mortar for the wear-resistant waterproof ground (33) is formed by mixing cement, quartz sand, silica fume, a water reducer, a defoaming agent, and water, a water consumption is strictly controlled, scrap iron finishes scattering in an initial setting stage, and a non-toxic and odorless cement seal curing agent is sprayed before the final light collection.

4. The green energy-saving cold store according to claim 1, wherein the first external heat insulation layer (34) of the cold storage door uses Cross-linked Polyethylene (XPE) foam, the second external heat insulation laver (38) of the wall surface and the ceiling uses an Ethylene-Vinyl Acetate (EVA) foam prefabricated block with a skin; and the first external heat insulation laver (34) and the second external heat insulation laver (38) use a non-toxic and odorless dye to dye black-and-yellow alternating anti-color-blocking strips without changing flexibility and elasticity of the material.

5. The green energy-saving cold store according to claim 1, wherein the color steel plate seam uses a sealant with membrane elasticity, firm adhesion to the color steel plate, low water vapor permeability and weather resistance, and is fully scraped flat; after the sealant is dried, the coating with membrane ductility, weather resistance, low water vapor permeability and firm adhesion to the color steel plate and the sealant is applied straddling the seam as a coating vapor barrier layer, the seam extends 30 mm wider on both sides, respectively, a self-tapping screw cap is coated with a fireproof coating (48), and a nail hole seam is sealed.

6. The green energy-saving cold store according to claim 1, wherein the bamboo mat uses a beam plate structure, the plate is spliced by bamboo pieces with a gap of 2 mm sandwiched between beams, the beams are alternately glued by bamboo pieces and fiberized bamboo veneers and are reinforced with bamboo nails and galvanized iron wires, and all the used bamboo materials are dewaxed.

7. The green energy-saving cold store according to claim 1, wherein the annular fireproof belt uses a wood substrate (70) and a fire-resistant heat insulation layer (72), the fire-resistant heat insulation layer (72) is formed by mixing water glass, expanded perlite and fire-resistant fibers, with $\lambda \leq 0.09$ w/m·k, and is reinforced to the beam, the column and the wood substrate (70) by using a fire-resistant rope (71), and ends of the fire-resistant ropes are knotted (76) and sealed with fire-resistant fibers and gypsum paste (75).

* * * * *